US009427055B2

(12) United States Patent
Bullock

(10) Patent No.: US 9,427,055 B2
(45) Date of Patent: Aug. 30, 2016

(54) MULTIPURPOSE CARRIER

(71) Applicant: Gary M. Bullock, Carrollton, GA (US)

(72) Inventor: Gary M. Bullock, Carrollton, GA (US)

( * ) Notice: Subject to any disclaimer, the term of this patent is extended or adjusted under 35 U.S.C. 154(b) by 0 days.

(21) Appl. No.: 14/514,865

(22) Filed: Oct. 15, 2014

(65) Prior Publication Data

US 2015/0102080 A1 Apr. 16, 2015

Related U.S. Application Data

(60) Provisional application No. 61/961,369, filed on Oct. 15, 2013.

(51) Int. Cl.

| | |
|---|---|
| ***A45F 4/02*** | (2006.01) |
| ***B60R 7/00*** | (2006.01) |
| ***A45C 9/00*** | (2006.01) |
| ***A45C 7/00*** | (2006.01) |

(52) U.S. Cl.

CPC ..... *A45C 9/00* (2013.01); *A45C 7/0077* (2013.01); *A45C 7/0095* (2013.01); *A45C 2007/0013* (2013.01)

(58) Field of Classification Search

CPC ..... A45C 9/00; A45C 7/0095; A45C 2007/0013; A45F 4/00

USPC ..... 224/577, 153, 407; 383/4

See application file for complete search history.

(56) References Cited

U.S. PATENT DOCUMENTS 4,273,380 A * 6/1981 Silvestri ..... A45C 9/00 297/188.06
4,298,016 A * 11/1981 Garelick ..... A61H 3/00 135/67
4,535,878 A * 8/1985 Grahl ..... A45C 3/10 190/1
4,674,787 A * 6/1987 DeVera ..... A63C 11/027 150/154
4,974,760 A * 12/1990 Miller ..... A61H 3/00 135/67
4,991,245 A * 2/1991 Franco ..... 5/419
5,012,963 A * 5/1991 Rosenbaum ..... A61H 3/00 135/67
5,110,219 A * 5/1992 Lopes ..... 383/4
5,154,331 A * 10/1992 Sanders ..... A61G 5/10 224/275
D377,573 S * 1/1997 Morgan ..... D6/596
5,622,300 A * 4/1997 Robinson ..... A45C 3/10 190/2
5,863,088 A * 1/1999 Kelly, Sr. ..... A45C 3/10 224/250
5,941,437 A * 8/1999 Okumura ..... A45C 3/00 224/585

(Continued)

*Primary Examiner* — Justin Larson
*Assistant Examiner* — Lester L Vanterpool
(74) *Attorney, Agent, or Firm* — Adams & Wilks

(57) ABSTRACT

A multipurpose carrier is configurable in various modes for performing various functions. The carrier includes a main body having front and rear sides and first and second pouches each provided with a storage compartment for removably storing various articles in the plurality of modes of the multipurpose carrier and provided with an opening accessible from the front side of the main body for permitting the articles to be inserted into and removed from the storage compartment. The main body includes a folding zone that separates the main body into a first section containing the first pouch and a second section containing the second pouch and about which the first and second sections are configured to be folded relative to one another to position the second pouch into substantial overlying relation relative to a surface portion of the rear side of the main body.

50 Claims, 22 Drawing Sheets

(56) References Cited

U.S. PATENT DOCUMENTS 5,961,018 A * 10/1999 Abelbeck ..... B62B 3/146 224/411
6,135,635 A * 10/2000 Miller et al. ..... 383/2
6,209,768 B1 * 4/2001 Boaz ..... 224/314
6,296,094 B1 * 10/2001 Knecht ..... A45C 7/0095 190/107
6,616,225 B2 * 9/2003 Graff ..... A47C 31/11 297/229
6,889,882 B1 * 5/2005 Leep ..... A45F 3/08 224/160
7,171,707 B2 * 2/2007 Landay ..... A47G 9/086 190/2
7,418,739 B2 * 9/2008 Chan ..... A41D 13/04 2/48
8,016,484 B1 * 9/2011 Cross ..... 383/4
8,777,076 B1 * 7/2014 Carrier ..... 224/577
2002/0139036 A1 * 10/2002 Smith ..... A01K 97/08 43/21.2
2002/0139826 A1 * 10/2002 Matthews ..... A45F 3/14 224/607
2003/0135925 A1 * 7/2003 Higashi ..... A45C 3/10 5/417
2004/0123386 A1 * 7/2004 Higashi ..... A45C 3/10 5/420
2005/0140103 A1 * 6/2005 Marchant ..... A45C 5/14 280/47.26
2005/0236450 A1 * 10/2005 Iannini ..... B63B 35/7946 224/577
2012/0057809 A1 * 3/2012 Buller ..... A45C 7/0077 383/2
2013/0256357 A1 * 10/2013 Prosperie ..... A45C 11/00 224/572

* cited by examiner

MULTIPURPOSE CARRIER

CROSS-REFERENCE TO RELATED APPLICATION

This application claims the benefit of U.S. Provisional Application No. 61/961,369, filed Oct. 15, 2013.

BACKGROUND OF THE INVENTION

1. Field of the Invention

The present invention relates generally to carriers, and more particularly to a highly versatile multipurpose carrier provided with storage compartments and configurable to a plurality of modes, including modes in which the carrier is adapted for removably holding a variety of articles in the storage compartments either independently (e.g., as a bag, tote or backpack) or as an accessory for portable and non-portable devices of the collapsible and non-collapsible types (e.g., chairs and durable medical devices), modes for transporting and/or storing portable devices of the collapsible and non-collapsible types, and combinations of such modes. The present invention also relates to an assembly including the multipurpose carrier and at least one portable device of the collapsible or non-collapsible type, as well as to an advertising device utilizing the multipurpose carrier.

2. Background Information

Portable collapsible chairs are well-known and are commonly used for sitting and sunning on a beach or for viewing various sporting events. Bringing a chair to the beach or such other event, however, creates certain problems. Such chairs must be lightweight and compact. The person carrying the chair is often also carrying other items that may be numerous and/or bulky. To facilitate carrying all these items, some persons try to put the items between folded components (e.g., folded seat and back) of the chair. This often results in the collapsed chair being too large for insertion into a supplied container for the collapsed chair and/or results in unfolding of the chair components and spilling the items.

Additionally, because of the large number of people one commonly finds at the beach or a sporting event, it would be commercially desirable for companies to place advertising logos upon such chairs. Existing chairs of the collapsible and non-collapsible type do not provide good unobstructed advertising panels. For example, when chairs are in the inclined position, the back of the chair where most advertising is placed is not visible due to the downward position of the seat back. Therefore, the use of recreational collapsible chairs as an advertising media has not been fully realized.

Moreover, durable medical devices used to aid handicapped, injured and/or aged individuals, such as walkers and wheelchairs, are well known. When using a walker, for example, the user must use both hands in moving the walker so as to provide stabilized or balanced walking movements. The need for using both hands makes it difficult for the individual to carry, while using the walker, various articles which the user may desire or require. While some holding devices (e.g., baskets, totes, bags) have been developed to meet the convenience/need of users in this regard, they have fallen short in providing the desired uses/objectives of users. For example, existing holding devices for walkers and wheelchairs do not provide easy access to articles being carried, and operations for mounting and removing such holding devices to and from such durable medical devices have been complicated and time consuming. When collapsible walkers and wheelchairs are folded in preparation to being transported from one location to another, for example, the holding devices must be removed and stored separately.

The present invention overcomes the foregoing drawbacks in the conventional art by providing a highly versatile multipurpose carrier which not only solves the use problems experienced with existing chairs and durable medical devices outlined above, but is also configured with one or more unobstructed panels for use as an advertising/promotional opportunity.

SUMMARY OF THE INVENTION

An object of the present invention is to provide a multipurpose carrier configurable to a plurality of modes, each mode being adapted to a desired function or functions, including a holder mode, an accessory mode, a storage mode, a transport mode and combinations of such modes.

Another object of the present invention is to provide a multipurpose carrier provided with storage compartments and which is configured to provide convenient access to the storage compartments in the plurality of modes for inserting into the storage compartments and removing therefrom a variety of articles.

Still another object of the present invention is to provide a multipurpose carrier that is light weight, rugged in construction, and inexpensive to manufacture.

Yet another object of the present invention is to provide a multipurpose carrier that is easy to use and comfortable for a user to carry for short or long distances.

A further object of the present invention is to provide an assembly including at least one portable device of the collapsible or non-collapsible type and the multipurpose carrier according to the present invention for use in combination with the portable device in the plurality of modes, such as for storing and transporting the portable device.

A further object of the present invention is to provide an advertising device using the multipurpose carrier according to the present invention which is provided with at least one unobstructed panel on which advertising indicia may be provided for use as an advertising opportunity, making the multipurpose carrier particularly suitable for use as a promotional item.

Still a further object of the present invention is to provide a method for using the multipurpose carrier according to the present invention in combination with a portable device of the collapsible type.

The foregoing and other objects of the present invention are carried out by a multipurpose carrier configurable to a plurality of modes, each mode being adapted to a desired function or functions. The multipurpose carrier comprises a main body having front and rear sides and first and second pouches each provided with a storage compartment for removably storing various articles in each of the plurality of modes of the multipurpose carrier and provided with an opening accessible from the front side of the main body for permitting the articles to be inserted into and removed from the storage compartment. The main body includes a folding zone that separates the main body into a first section containing the first pouch and a second section containing the second pouch and about which the first and second sections are configured to be folded relative to one another to position the second pouch into substantial overlying relation relative to a surface portion of the rear side of the main body.

The main body is preferably formed of a plurality of panels of a flexible material. In one embodiment, the plurality of panels include a base panel and two top panels fixedly attached to a first surface of the base panel. One of the top panels and a portion of the first surface of the base panel forms the first pouch, and the other of the top panels and another portion of the first surface of the base panel forms the second pouch.

The multipurpose carrier comprises a connection assembly mounted on the main body for securing and/or configuring the multipurpose carrier in the plurality of modes. In one embodiment, the connection assembly comprises a plurality of pairs of mating male and female connectors each fixedly attached by a strap to one of a plurality of attachment regions provided at preselected portions of the rear side of the main body corresponding to the first and second sections.

In another aspect, the present invention is directed to an assembly comprising at least one portable device of the collapsible or non-collapsible type, and a multipurpose carrier having storage compartments and configurable to a plurality of modes including a holder mode in which the multipurpose carrier is configured to be removably secured to the portable device in the non-collapsed state for holding a variety of articles in the storage compartments, a storage mode in which the multipurpose carrier is configured to store the portable device in the collapsed state, and a transport mode in which the multipurpose carrier is configured to both store and transport the portable device in the collapsed state.

In one embodiment of the assembly, the portable device is a chair of the collapsible type provided with a back rest and a top rail and configured to be transitioned between a collapsed state and a non-collapsed state. The multipurpose carrier has a main body including a folding zone that separates the main body into a first section containing one of the storage compartments and a second section containing another one of the storage compartments and about which the first and second sections are configured to be folded relative to one another. In the holder mode of the multipurpose carrier, the first and second sections of the main body are folded relative to one another so as to be disposed on opposite sides of the back rest with the folding zone substantially overlying the top rail of the chair.

In another embodiment of the assembly, the portable device is a walker of the collapsible type provided with support legs interconnected by a cross members and configured to be transitioned between a collapsed state and a non-collapsed state. The multipurpose carrier has a main body including a folding zone that separates the main body into a first section containing one of the storage compartments and a second section containing another one of the storage compartments and about which the first and second sections are configured to be folded relative to one another. In the holder mode of the multipurpose carrier, the first and second sections of the main body of the multipurpose carrier are folded relative to one another so as to be disposed on opposite sides of one of the cross members of the walker with the folding zone substantially overlying the one cross member.

In another aspect, the present invention is directed to an advertising device utilizing the multipurpose carrier and/or the assembly according the present invention.

In yet another aspect, the present invention is directed to a method of using a carrier in combination with a portable device of the collapsible type configured to be transitioned between a collapsible state and a non-collapsible state. The multipurpose carrier has at least one storage compartment and is configurable to a plurality of modes each adapted to a desired function or functions. When the portable device in the non-collapsed state, the multipurpose carrier is disposed relative to the portable device to configure the multipurpose carrier to a holder mode during which one or more articles may be inserted into and removed from the storage compartment of the multipurpose carrier. When the portable device is in the collapsed state, the multipurpose carrier is removably secured relative to the portable device to configure the multipurpose carrier to one of a transport mode, during which the multipurpose carrier is configured for transporting the collapsed portable device, and a combined storage and transport mode, during which the multipurpose carrier is configured for both storing and transporting the collapsed portable device.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

Figure 1:
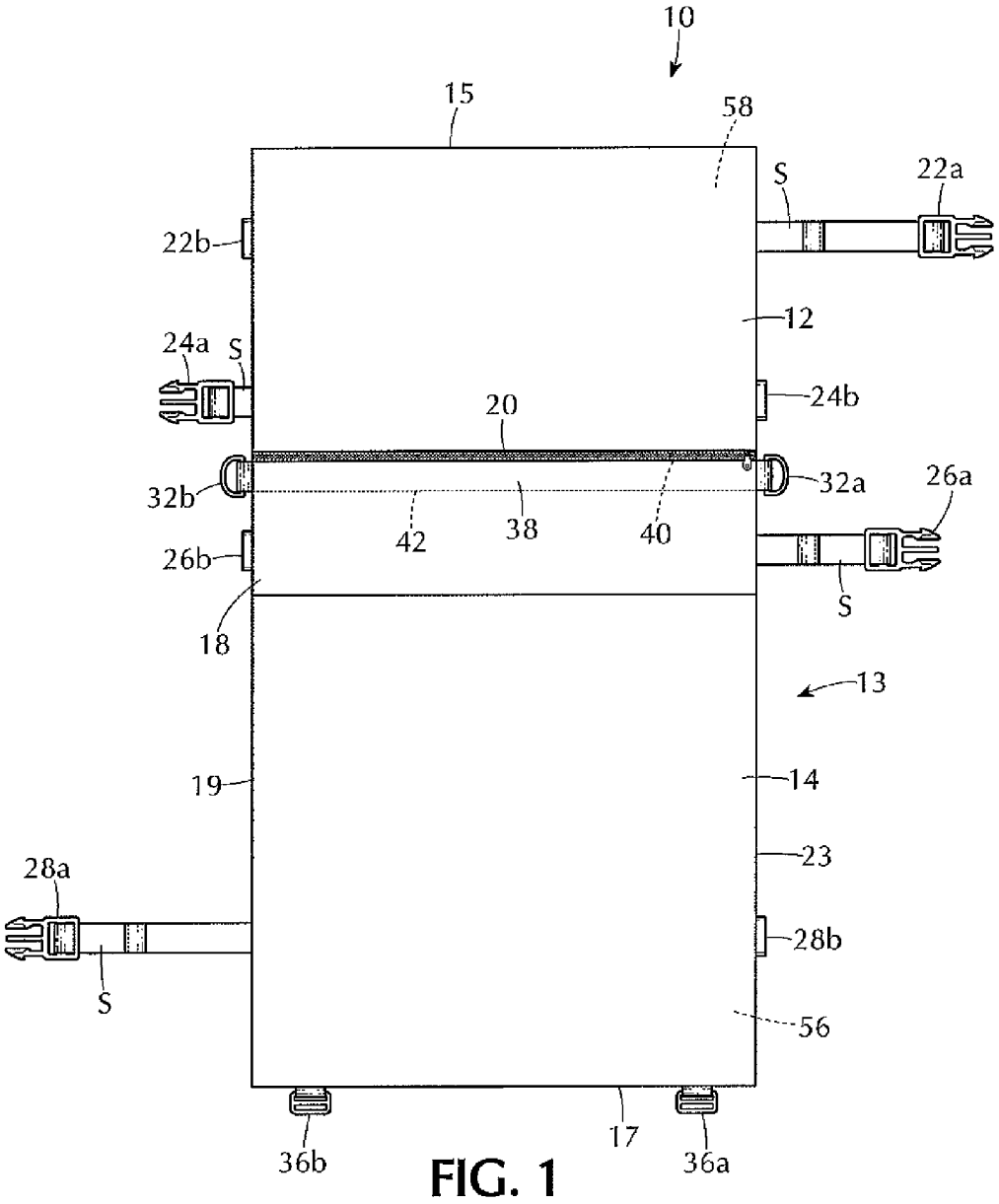
FIG. 1 is a front view of the multipurpose carrier according to an embodiment of the present invention.

The word "exemplary" is used herein to mean "serving as an example, instance, or illustration." Any embodiment described herein as "exemplary" is not necessarily to be construed as preferred or advantageous over other embodiments. It is to be understood that the terminology used herein is for purposes of describing particular embodiments only, and is not intended to be limiting. As used in the specification and appended claims, the terms "a", "an" and "the" include both singular and plural referents, unless the context clearly dictates otherwise.

The detailed description set forth below in connection with the appended drawings is intended as a description of exemplary embodiments of the present invention and is not intended to represent the only embodiments in which the present invention can be practiced. The detailed description includes specific details for the purpose of providing a thorough understanding of the exemplary embodiments of the invention. It will be apparent to those skilled in the art that the exemplary embodiments of the invention may be practiced without these specific details.

For convenience of description, the terms "upper", "lower", "top", "bottom", "front", "rear", "right", "left", "side" and words of similar import will have reference to the various members and components of the multipurpose carrier of the present invention as arranged and illustrated in the figures of the drawings and described hereinafter in detail. As used herein the term "substantially" means to a considerable, large, and/or great, but not necessarily whole and/or entire, extent and/or degree. The term "about", and the use of ranges in general whether or not qualified by the term "about", means that the number comprehended is not limited to the exact number set forth herein, and is intended to refer to ranges substantially within the quoted range not departing from the scope of the invention.

Additionally, embodiments in the detailed description will be described with various views as ideal exemplary views of the inventive concept. Accordingly, shapes and configurations of the exemplary views may be modified according to manufacturing techniques and/or allowable errors. Therefore, the embodiments of the inventive concept are not limited to the specific shapes and configurations illustrated in the exemplary views, but may include other shapes and configurations that may be created according to manufacturing processes.

As described herein for the exemplary embodiments of the present invention with reference to the drawings, the multipurpose carrier is provided with storage compartments and is configurable and adapted to a plurality of modes, each mode being adapted to a desired function or functions, including a holder mode, an accessory mode, a storage mode, a transport mode and combinations of such modes. It will be appreciated, however, that the multipurpose carrier is not limited to the foregoing exemplary modes and may be configured and adapted to various other modes different from the exemplary modes described herein without departing from the spirit and scope of the invention.

Exemplary modes to which the multipurpose carrier according to the present invention may be configured and adapted are generally defined as follows. A first mode of the multipurpose carrier defines a holder mode during which the multipurpose carrier is configured and adapted for use independently as a bag, tote or backpack for holding a variety of articles in the storage compartments. A second mode of the multipurpose carrier defines an accessory mode in which the multipurpose carrier is configured and adapted as an accessory for portable and non-portable devices of the collapsible or non-collapsible types, such as chairs and durable medical devices, and during which the multipurpose carrier is removably mounted to the device for use in the holding mode to hold a variety of articles in the storage compartments. A third mode of the multipurpose carrier defines a storage mode during which the multipurpose carrier is configured and adapted for storing a portable devices of the collapsible and non-collapsible types. A fourth mode of the multipurpose carrier defines a transport mode during which the multipurpose carrier is configured and adapted for transporting portable device of the collapsible and non-collapsible types. A fifth mode of the multipurpose carrier defines a mode during which the multipurpose carrier is configured and adapted for storing and transporting portable devices of the collapsible and non-collapsible types. A sixth mode of the multipurpose carrier defines a mode during which the multipurpose carrier is further configured and adapted for use in the holding mode to hold a variety of articles in the storage compartments during any of the third, fourth and fifth modes.

Figure 2:
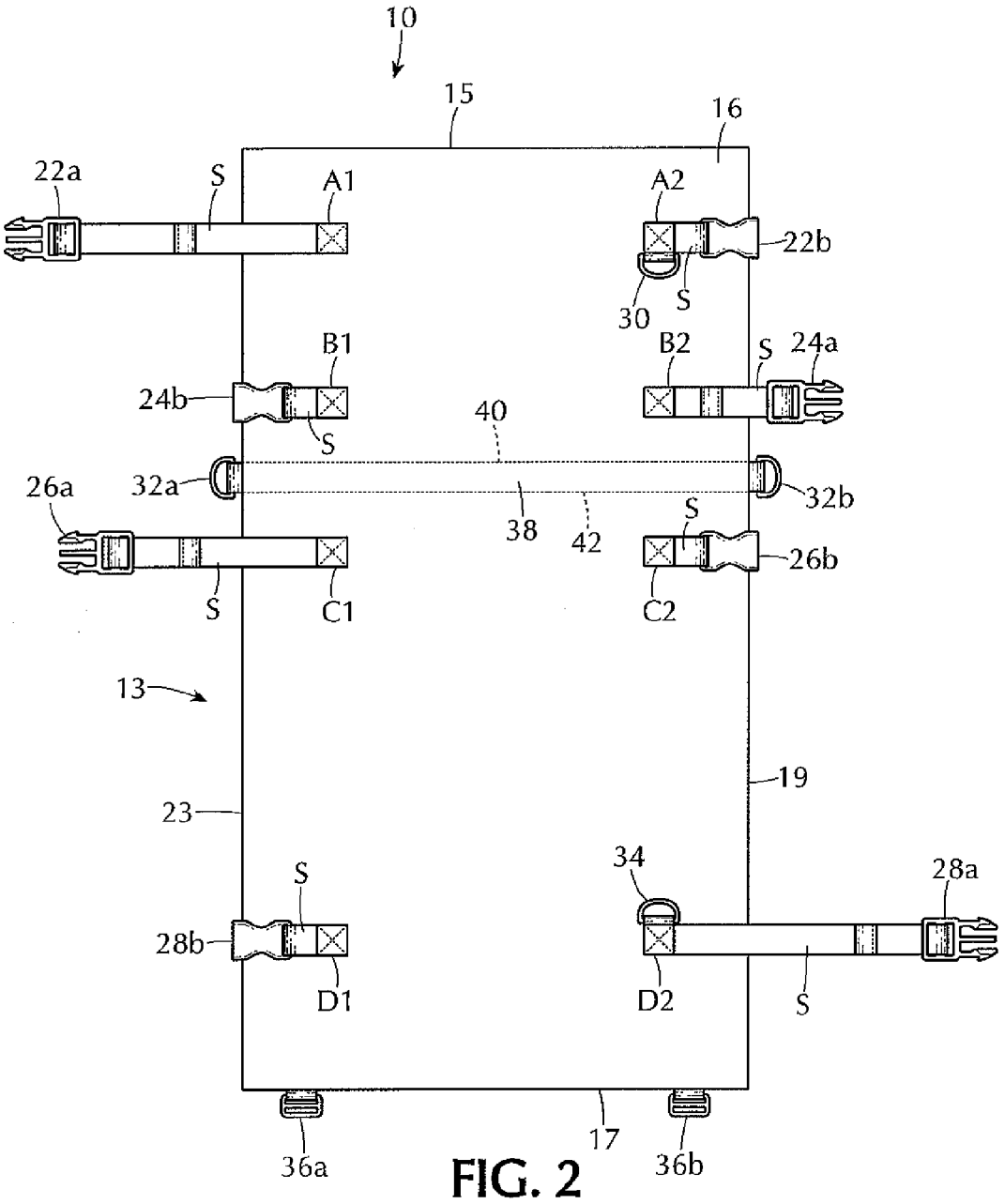
FIG. 2 is a rear view of the multipurpose carrier shown in FIG. 1.
Figure 3:
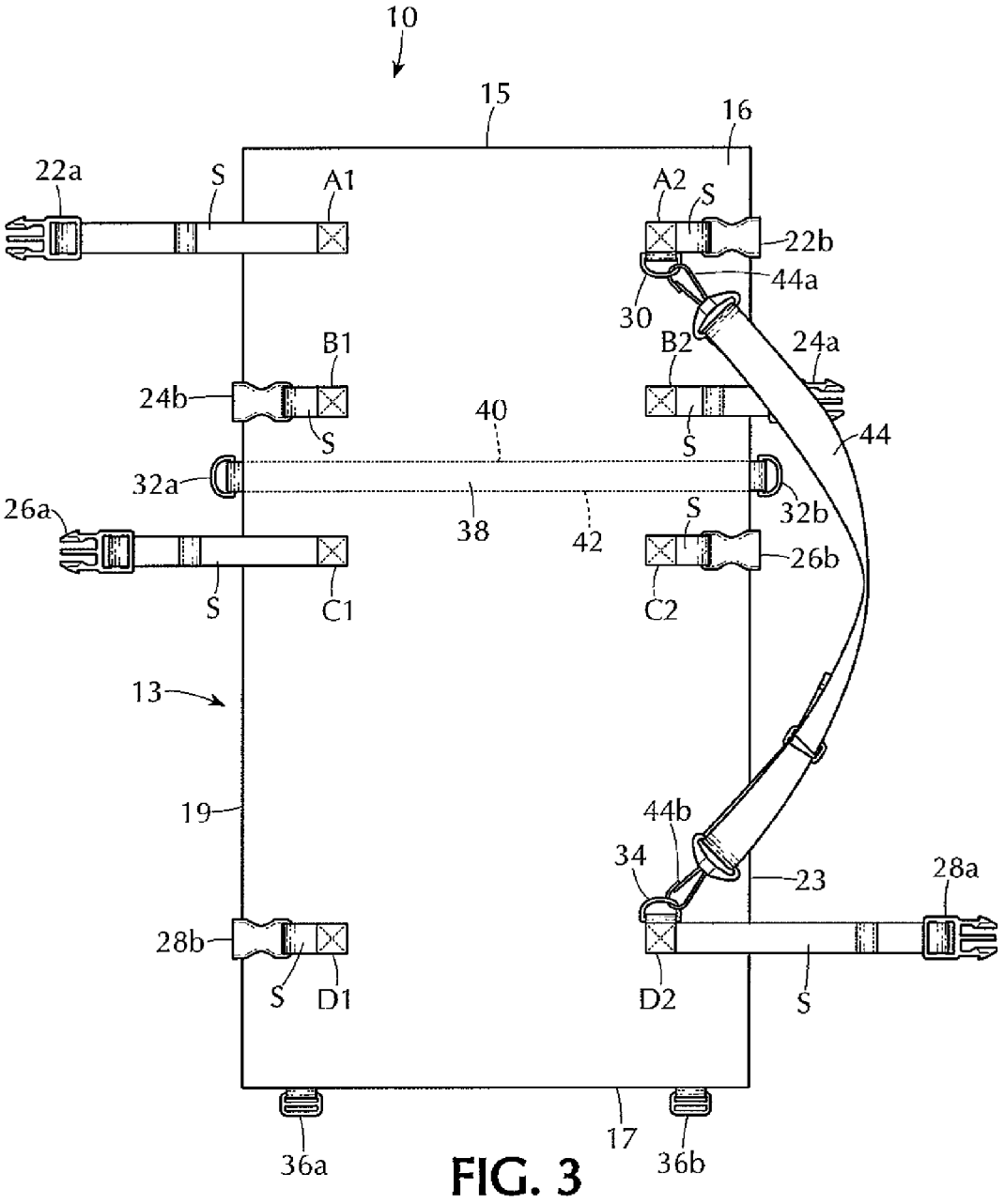
FIG. 3 is a view of the multipurpose carrier similar to FIG. 2 but additionally showing a carrying strap removably attached to a main body of the carrier.
Figure 10:
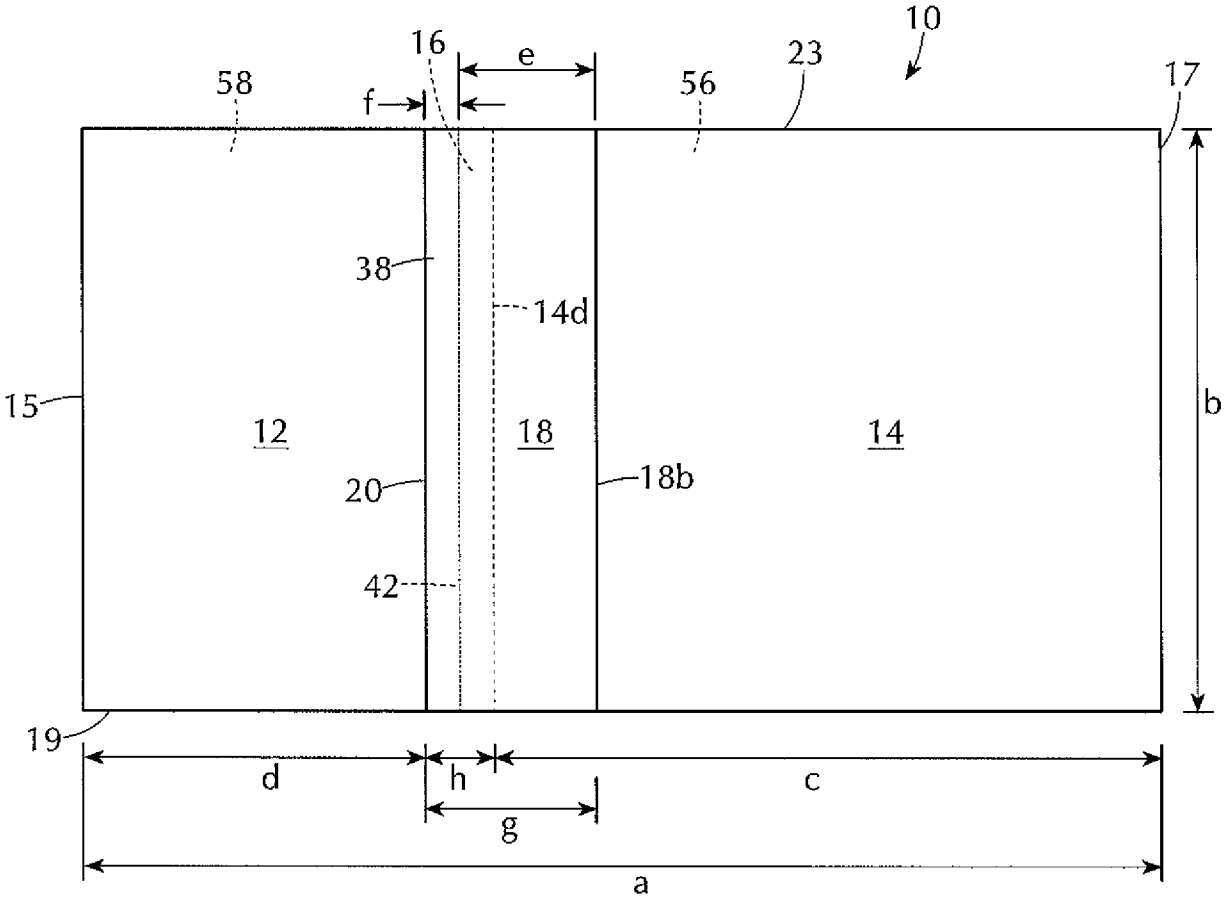
FIG. 10 is a front view of the multipurpose carrier according to the present invention, with various connecting elements omitted for clarity of illustration, showing dimensions and corresponding positional relationships between various features and parts of the multipurpose carrier, including panels forming the main body of the multipurpose carrier.
Figure 11:
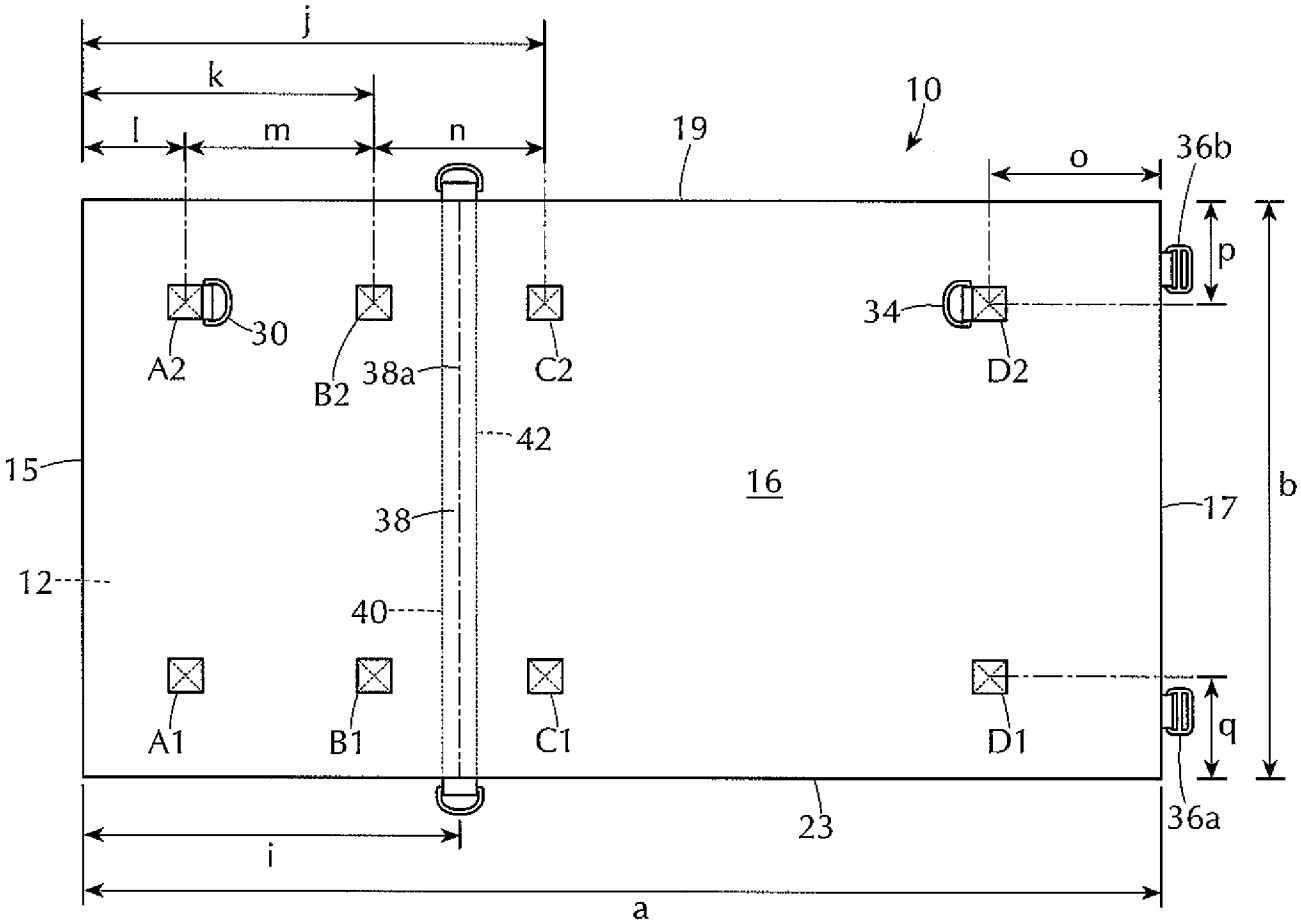
FIG. 11 is a rear view of the multipurpose carrier according to the present invention, with certain connecting elements omitted for clarity of illustration, showing dimensions and corresponding positional relationships between various other parts and features of the multipurpose carrier, including attachment regions for the connection elements.
Figure 12A:
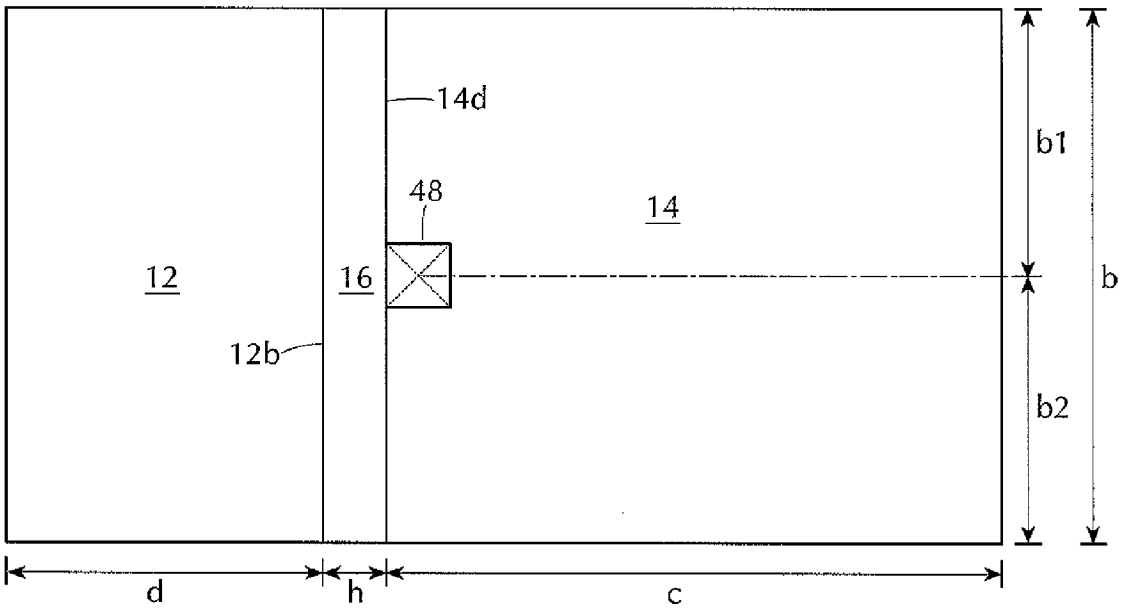
FIG. 12A is a front view of the multipurpose carrier according to the present invention, with certain connecting elements omitted for clarity of illustration, showing top panels attached to a base panel of the main body as well as relative dimensional relationships between the top and base panels, and with the closure panel for the first pouch omitted to illustrate a gap between two of the top panels.
Figure 12B:
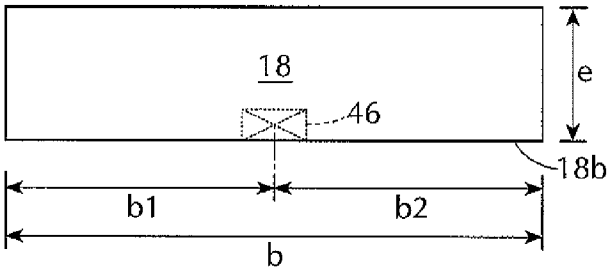
FIG. 12B is a front view of the closure panel omitted from FIG. 12A.
Figure 13:
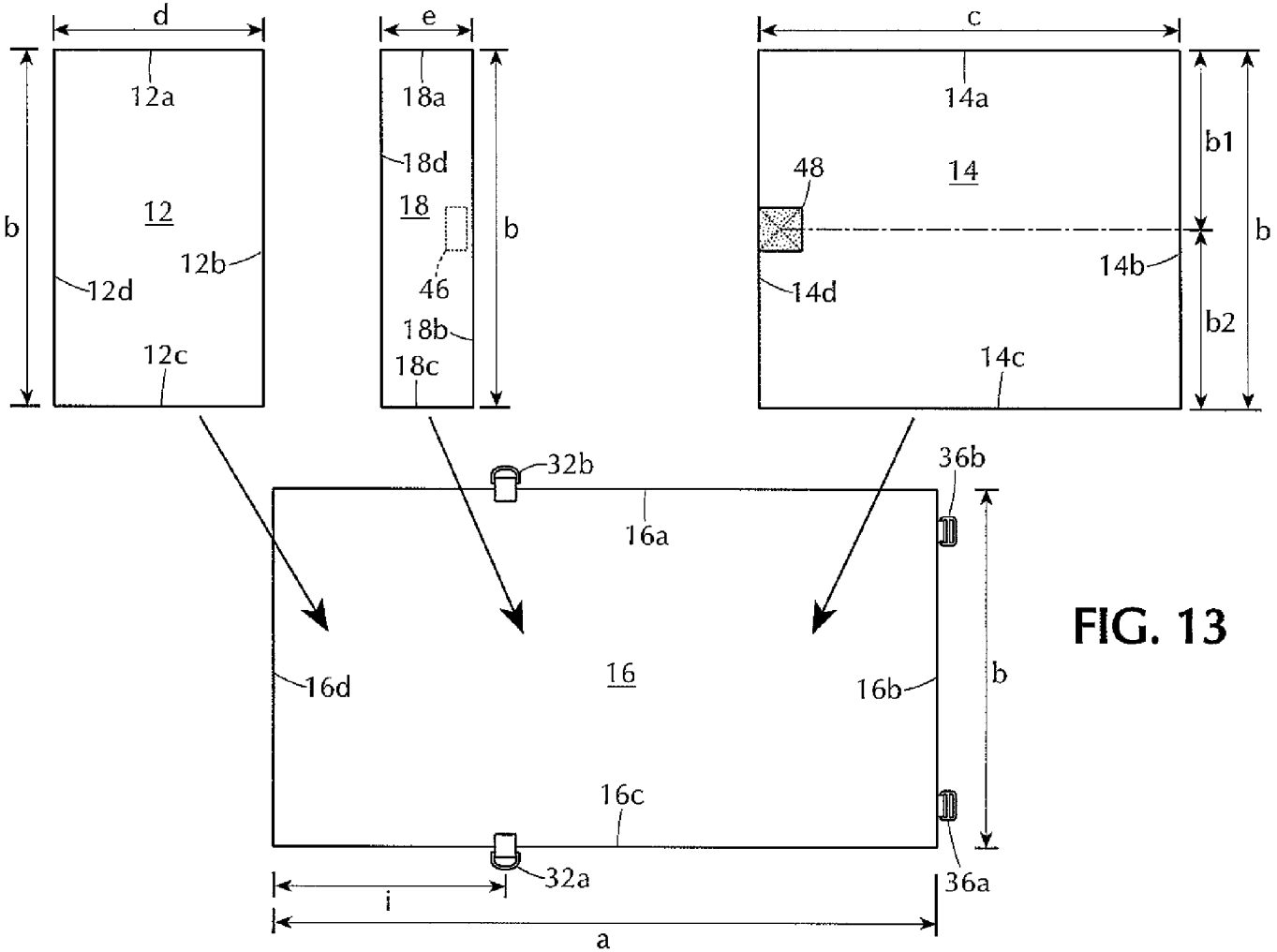
FIG. 13 is an exploded view of the multipurpose carrier according to the present invention, with certain connecting elements omitted for clarity of illustration, showing the top and closure panels as they relate to the base panel, and showing relative dimensional relationships between the top, closure and base panels.
Figure 14:
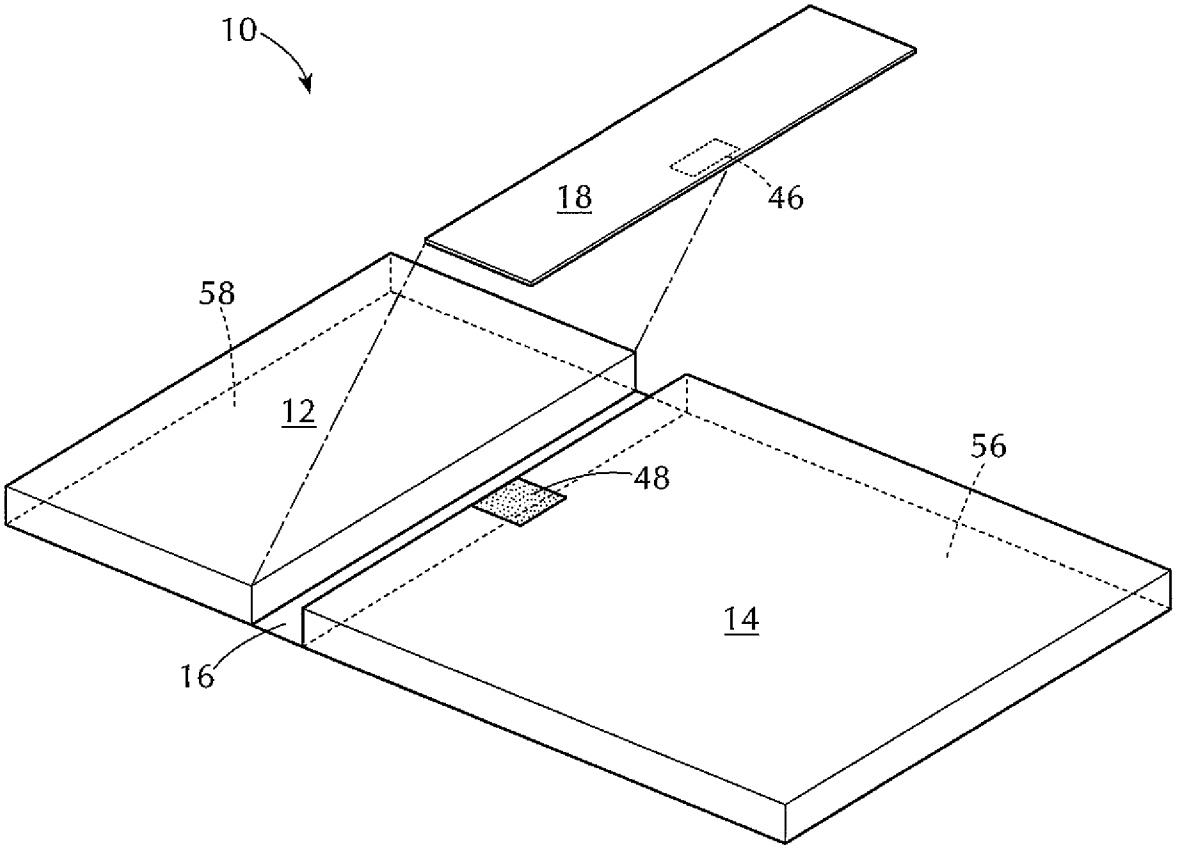
FIG. 14 is a perspective view showing positional relationships between the top, base and closure panels of the multipurpose carrier according to the present invention.

Referring now to the drawings in detail, where like numerals refer to like parts or elements, there is shown in FIGS. 1-6 and 10-14 a multipurpose carrier (hereinafter also "carrier"), generally designated at 10, in accordance with an exemplary embodiment of the present invention. FIGS. 1, 4-6 and 10 are front views and FIGS. 2, 3 and 11 are rear views of the carrier 10. FIG. 12A is a front view of the carrier 10 showing top panels 12, 14 attached to a base panel 16 forming a main body 13 of the carrier 10, and showing relative dimensional relationships between the top and base panels. FIG. 12B is a front view of a closure panel 18 of the main body, which has been omitted from FIG. 12A to illustrate certain features of the carrier 10 as further described below. FIG. 13 is an exploded view of the carrier 10 showing the top panels 12, 14 and the closure panel 18 as they relate to the base panel 16, and showing relative dimensional relationships between the top, closure and base panels. FIG. 14 is a perspective view showing positional relationships between the base panel 16, top panels 12, 14 and closure panel 18.

It will be appreciated that certain features and components of the carrier 10 have been omitted from some of the figures described herein for clarity of illustration only. For example, certain connecting elements of an exemplary embodiment of a connection assembly of the carrier 10, including buckle arrangements, straps, and ring-shaped members as further described below, have been omitted from various figures, including FIGS. 4-11 and 15-22, for clarity of illustration only, The main body 13 of the carrier 10 has an elongated shape defining first and second longitudinal ends 15, 17 and first and second lateral side edges 19, 23, and front and rear sides bounded by the longitudinal ends 15, 17 and the lateral side edges 19, 23. As shown in FIGS. 10-11, the main body 13 has a length a corresponding to a distance between the longitudinal ends 15, 17 and a width b corresponding to distance between the lateral side edges 19, 23. Although in this exemplary embodiment the main body 13, when laid flat as shown in FIGS. 1-2, has the shape of an elongated rectangle with the longitudinal ends 15, 17 and the lateral side edges 19, 23 defining the shorter and longer sides, respectively, it will be appreciated that other configurations are also suitable for the main body 13 without departing from the spirit and scope of the invention.

Referring to FIGS. 13 and 14, the main body 13 is constructed of the four panels 12, 14, 16 and 18 which, when fixedly attached together as described below, form the front and rear sides of the main body 13. Panel 16 is the base panel with a bottom surface forming the rear side of the main body 13, and panels 12, 14 and 18 are the top panels fixedly attached to a top surface of the base panel 16 and forming the front side of the main body 13. Each of the top panels 12, 14, 18 and the base panel 16 has a width b corresponding generally to the width of the main body 13, and a length a of the base panel 16 corresponds generally to the length of the main body 13. The top panels 14, 12 and 18 have respective lengths c, d and e. In the exemplary embodiment, the top panels 12, 14, 18 and the base panel 16 are substantially rectangular in shape with respective peripheral edges or sides 12*a*-12*d*, 14*a*-14*d*, 18*a*-18*d* and 16*a*-16*d*. When the top panels 14, 12, 18 are fixedly attached to the base panel 16 to form the main body 13, edges 12*d*, 16*d* correspond to the longitudinal end 15, edges 14*b*, 16*b* correspond to the longitudinal end 17, edges 12*c*, 14*c*, 16*c*, 18*c* correspond to the lateral side edge 19, edges 12*a*, 14*a*, 16*a*, 18*a* correspond to lateral side edge 23, and edges 12*b*, 14*d*, 18*b*, 18*d* are disposed substantially parallel to longitudinal ends 15, 17. FIG. 13 also shows attachment positions on the top panels 14, 18 and base panel 16 for ring-shaped members in the form of eyelets 32*a*, 32*b*, 36*a*, 36*b* and for hook and loop patches 46, 48, as further described below.

Figure 4:
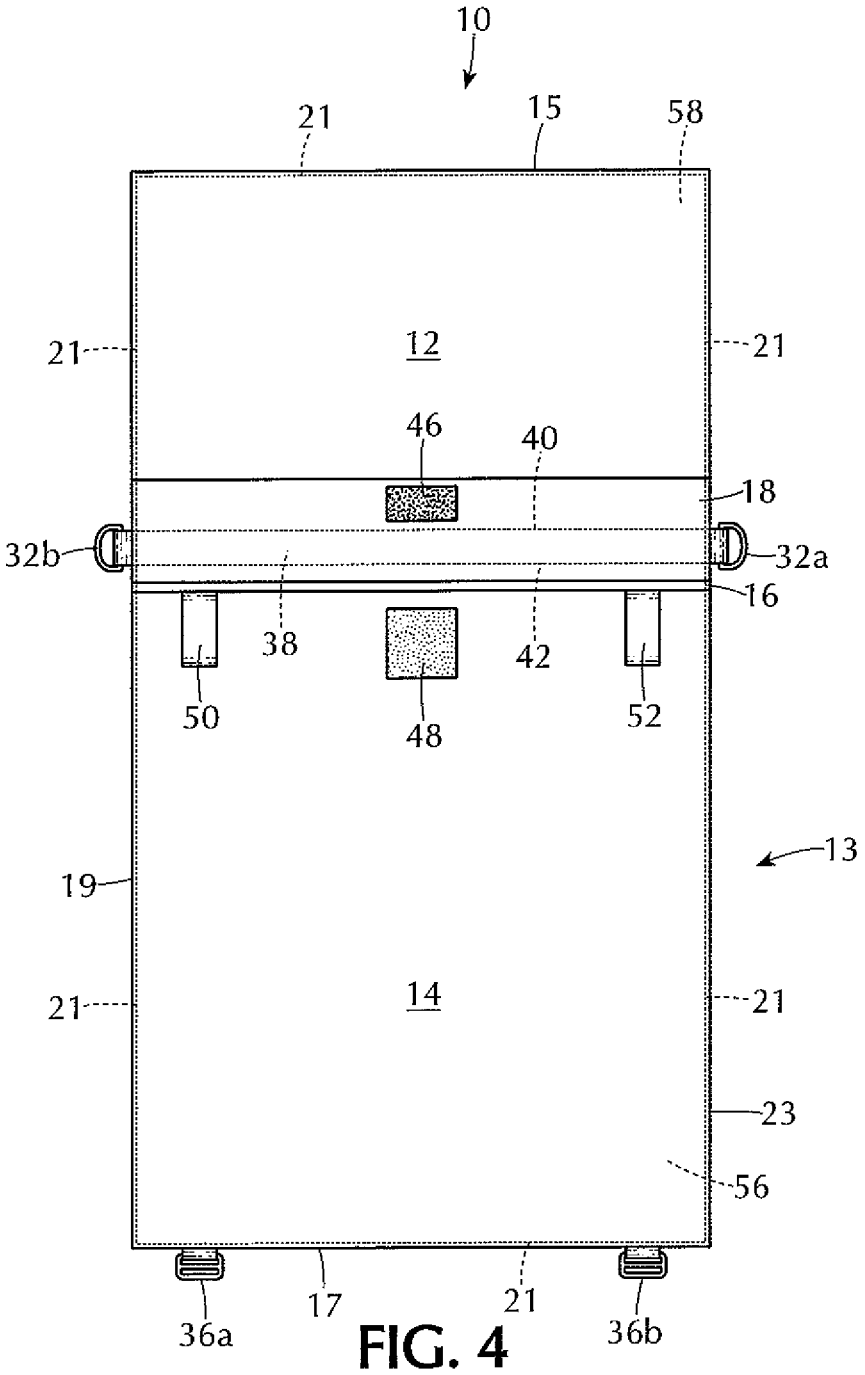
FIG. 4 is a front view of the multipurpose carrier similar to FIG. 1 with certain connecting elements omitted for clarity of illustration, and with a closure panel for one of the pouches shown in an open state to illustrate a fastening system including fastening elements for the closure panel.

In the exemplary embodiment, the panels 12, 14, 16 and 18 are fixedly attached together by a sewing process to form the main body 13. Referring to FIGS. 4 and 13, top panels 12 and 14 are sewn to the base panel 16 by horizontal and vertical lines of stitching 21 passing through the top panels 12, 14 and the base panel 16 along corresponding peripheral edges of the panels 12, 14 and 16. The top panel 18 is sewn to the base panel 16 by horizontal, spaced-apart stitch lines 40, 42 passing through the top panel 18 and the base panel 16 and extending substantially parallel to one another across the entire width of the main body 13 (i.e., from lateral side edge 19 to lateral side edge 23). It will be appreciated that the panels 12, 14, 16 and 18 may be fixedly attached together by any other known fastening arrangement in addition to or alternative to stitching including, but not limited to, high temperature forming, hook and loop fastening systems, clips, snaps, zippers, adhesives and combinations thereof. The method of attachment for the panels 12, 14, 16 and 18 is best determined by the type of material used for the panels and, therefore, is not limited to any of the foregoing individual or combination of fastening arrangements.

The panels 12, 14, 16 and 18 forming the main body 13 of the carrier 10 are preferably formed of durable, flexible materials selected with a desired appearance. Such materials include, but are not limited to, natural and synthetic materials, sheet formed, pressed, or woven. Preferred materials include fabric, flexible polymeric materials, mixed polymers, nylons, vinyl, polyester, leather, cotton, wool, canvas, and mixtures thereof. The material selected may also be water repellant and/or water resistant. If desired, the material may contain drainage holes, such as in a bottom portion of the storage compartments provided in the pouches, as further described below, in order to avoid any undesired collection of liquid. If preferred, the material for the panels may be selected so as to be easily screened and/or embroidered.

Referring to FIGS. 1, 4-6 and 10, the main body 13 has two pocket sections in the form of first and second pouches provided with respective storage compartments 56, 58 within which various articles, items and accessories can be readily and safely accommodated, stored and carried during use of the carrier 10 in the various modes as further described below. The first pouch provided with the storage compartment 56 is formed by the base panel 16 and top panel 14, and the second pouch provided with the storage compartment 58 is formed by the base panel 16 and top panel 12.

Figure 6:
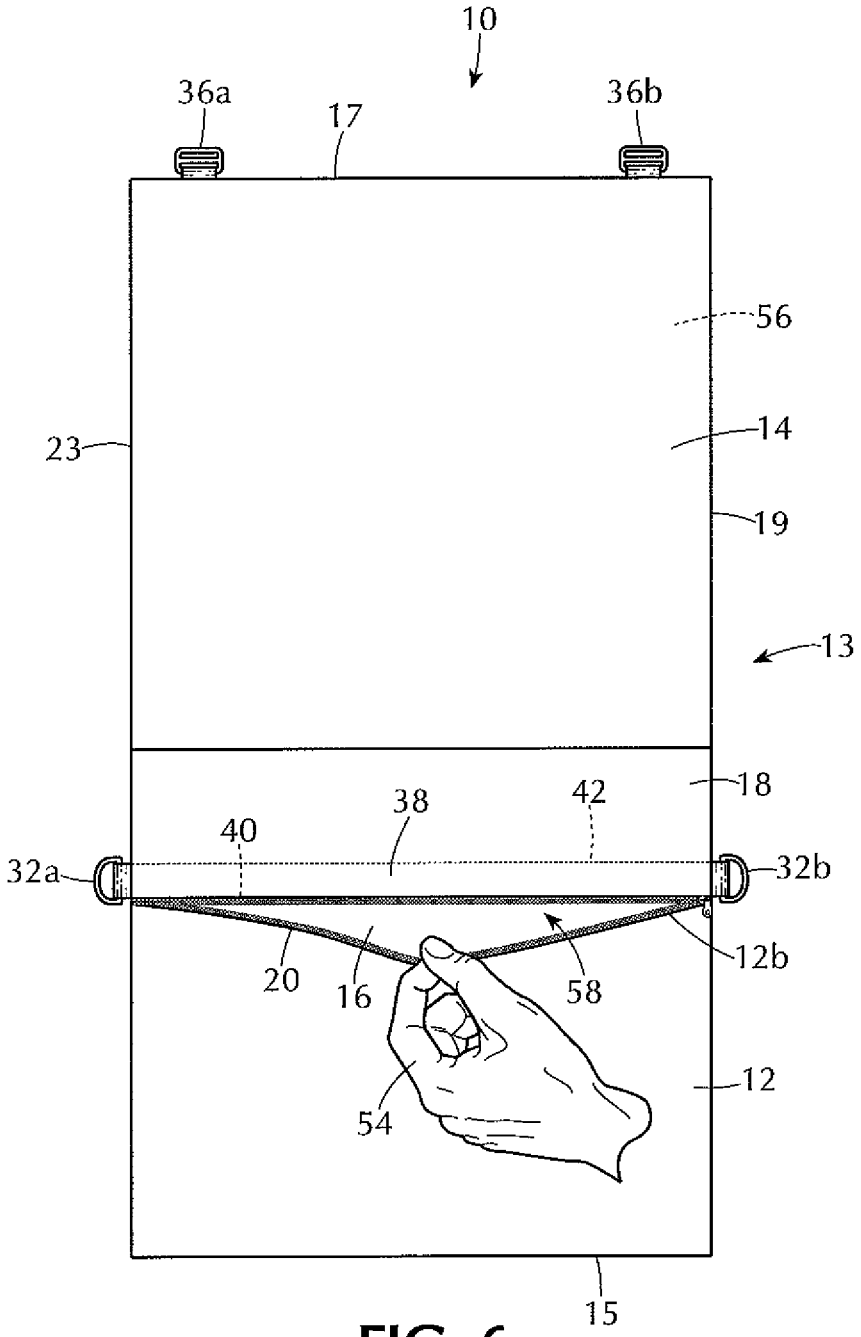
FIG. 6 is a front view of the multipurpose carrier similar to FIG. 5 but with another top panel forming a second pouch being pulled open to show an interior portion of a storage compartment in the second pouch, with stitch lines 21 shown in FIG. 4 omitted for clarity of illustration.

The top panel 12 is fixedly attached to the base panel 16 on three sides extending in the length and width directions of the main body 13 (i.e., sides 12*a*, 12*c* along lateral side edges 19, 23 and side 12*d* along longitudinal end 15) and is open on a fourth side in the width direction of the main body 13 (i.e., side 12*b* extending from the lateral side edge 19 to the lateral side edge 23) to form an opening providing access into the storage compartment 58 of the second pouch. The second pouch provided with the storage compartment 58 has a zipper 20 or a similar reversible sealable closure on the fourth side 12*b* of the top panel 12 which, when opened, allows access into the storage compartment 58. The zipper 20 extends across the entire width of the main body 13 and is substantially parallel to horizontal stitch line 42. FIG. 6 shows the zipper 20 in an open state and with a portion of the fourth side 12*b* of the top panel 12 being pulled out by a hand 54 to show an interior portion of the storage compartment 58 while exposing a corresponding a portion of the top surface of the base panel 16. FIG. 1 shows the zipper 20 in a closed state.

Figure 5:
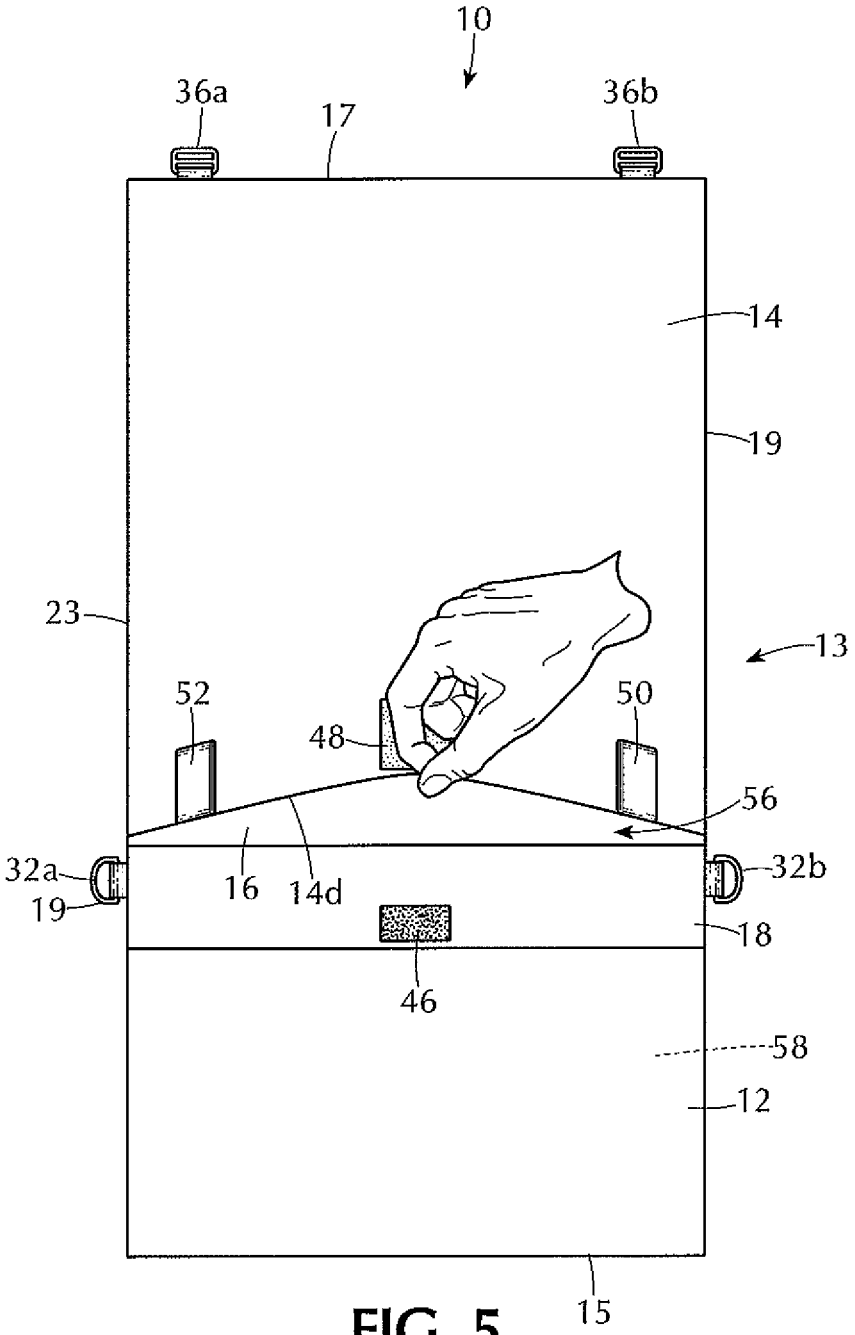
FIG. 5 is a front view of the multipurpose carrier similar to the view shown in FIG. 4 but rotated 180 degrees, and further illustrating a top panel forming a first pouch being pulled open to show an interior portion of a storage compartment in the first pouch, with stitch lines 21, 40 and 42 shown in FIG. 4 omitted for clarity of illustration.

The top panel 14 is fixedly attached to the base panel 16 on three sides extending in the length and width directions of the main body 13 (i.e., sides 14*a*, 14*b*, 14*c* along lateral side edges 19, 23 and one side along longitudinal end 17) and is open on a fourth side 14*d* (FIGS. 5 and 10) extending in the width direction of the main body 13 (i.e., side 14*d* extending from the lateral side edge 19 to the lateral side edge 23) to form an opening providing access into the compartment 56 of the first pouch. The top panel 18 is fixedly attached to the base panel 16 by sewing it to the base panel 16 only alongside 18*d*, as denoted by stitch line 42 extending in the width direction of the main body 13. The top panel 18 defines a closure panel in the form of a flap that is releasably attachable to and detachable from the top panel 14. As best shown in FIG. 10, when releasably attached to the top panel 14 (i.e., a closed state of the closure panel 18), the closure panel 18 is arranged to extend over the fourth side 14*d* of the top panel 14. When detached from the top panel 14 (i.e., in an open state of the closure panel 18), as shown in FIGS. 4 and 5, the opening providing access into the storage compartment 56 is readily accessible. FIG. 5 also shows a portion of the fourth side 14*d* of the top panel 14 being pulled out by a hand 54 to show an interior portion of the storage compartment 56 while exposing a portion of the top surface of the base panel 16.

The closure panel 18 and top panel 14 include a releasable fastening system for releasably fastening the closure panel 18 and top panel 14 as described above. In the exemplary embodiment, the releasable fastening system is a hook and loop fastening system including a single patch 46 of hook portions attached to an inner surface portion of the closure panel 18 proximate edge 18*b*, and a single patch 48 of a loop material attached to an outer surface portion of the top panel 14 proximate edge 14*d*. FIGS. 4 and 5 show the closure panel 18 detached from the top panel 14 (i.e., hook and loop patches 46, 48 are detached from one another) to provide access to the storage compartment 56, while FIGS. 1 and 6 show the closure panel 18 releasably attached to the top panel 14 (i.e., hook and loop patches 46, 48 are releasably attached to one another). As shown in FIGS. 12A, 12B and 13, the hook and loop patches 46, 48 are provided at substantially central portions of the closure panel 18 and the top panel 14, respectively, in the width direction b (e.g., dimensions b1 and b2 are substantially equal to each other). Alternatively, multiple hook and loop patches 46, 48 may be provided on the top panel 18 and closure panel 14, respectively, along the width direction thereof, or each of the hook and loop patches 46, 48 may be in the form of a continuous strip provided entirely or substantially along the width of the top panel 14 and closure panel 18, respectively.

FIG. 14 is a partial exploded view in perspective showing the general placement arrangement of the panels 12, 14, 16 and 18 relative one another, with the panel 18 (closure panel) shown disconnected from the base panel 16. The elevations of the panels 12 and 14 in FIG. 14 are shown exaggerated for clarity of illustration only, including illustration of the configurations of the storage compartment 58 of the second pouch formed by the base panel 16 and the top panel 12 and the storage compartment 56 of the first pouch formed by the base panel 16 and the top panel 14. FIG. 14 also shows the positions of the hook and loop patches 46, 48 relative to the top panels 18, 14, respectively, and to one another.

While in the exemplary embodiment described herein the releasable closures for the pouches provided with the compartments 56, 58 are embodied as a closure panel 18 and a zipper 20, respectively, it will be appreciated that the zipper 20 may be replaced with a closure panel similar to closure panel 18 and/or the closure panel 18 may be replaced with a zipper similar to zipper 20, or both closures may be in the form of zippers or closure panels. In alternative embodiments, releasable closures other than zippers and closure panels may be used, including hook and loop fastening systems, clips, snaps, buckles and combinations thereof. In further alternative embodiments, one or both of the releasable closures for the two pouches provided with the compartments 56, 58 may be omitted from the main body 13, thereby eliminating the need for opening and closing operations of the openings providing access to the compartments.

As described above, the closure panel 18 is sewn to the base panel 16 by spaced-apart, substantially parallel horizontal stitch lines 40, 42 extending across the entire width of the main body 13, with the stitch lines 40, 42 being effected such that the closure panel 18 will overlie a portion of the top panel 14 past the side 14*d* of the top panel 14. The zipper 20, which is substantially parallel to the horizontal stitch line 42, may be any conventional zipper, such as a zipper having zipper teeth on which are mounted a slider head with a pull tab (shown in FIG. 1) and zipper tape portions (not shown) on which the zipper teeth are mounted. In addition to serving to fixedly attach the top panel 18 to the base panel 16 as described above, the horizontal stitch line 40 also functions to secure one of the zipper tapes to the base panel 16, while the other zipper tape is sewn to the fourth side (i.e., the non-stitched side) of the top panel 12 by appropriate stitching (not shown) also extending across the width of the main body 13.

Referring now to FIGS. 1-6, 10 and 11, a horizontal strip 38 extending across the entire width of the main body 13 is formed by and between the horizontal stitch lines 40, 42 passing through the closure panel 18 and the main body 13 (stitch line 42) and through the closure panel 18, the main body 13 and the zipper tape portion (stitch line 40). The strip 38 has a central axis 38*a* (FIG. 11) and defines a gap disposed between and separating the main body 13 into a first section having the first pouch formed of the top panel 14 and the main body 13 and provided with the storage compartment 56 (FIG. 5), and a second section having the second pouch formed of the top panel 12 and the main body 13 and provided with the storage compartment 58 (FIG. 6). In FIG. 10, the dimension f denotes the size of the gap in the length direction of the main body 13 (denoted by the direction of dimension a) as well as identifies the position of the gap (and thus the strip 38) relative to the longitudinal ends 15, 17 of the main body 13. As will be readily appreciated, in the exemplary embodiment the strip 38 is disposed substantially closer to the longitudinal end 15 than to the longitudinal end 17 of the main body 13, making a length c of the first section (corresponding to the top panel 14) of the main body 13 larger than a length d of the second section (corresponding to the top panel 12) of the main panel 13. As such, the first pouch (hereinafter "large pouch") in the first section of the main body 13 is larger than the second pouch (hereinafter "small pouch") in the second section of the main body 13, as shown in FIGS. 1-6, 10 and 11, for example, resulting in the storage compartment 56 being larger, and thus of greater storing capacity, than the storage compartment 58. As described below with reference to FIGS. 19-22 illustrating a storage mode (third mode) and transport mode (fourth mode) of the carrier 10, with a fifth mode collectively defining a combination of the storage and transport modes, the storage compartment 56 of the large pouch and corresponding opening provides a cavity for receiving and housing one or more collapsible items, such as a portable chair of the collapsible type 250, in a state in which the collapsible item in the collapsed state can be securely stored and transported or carried by the carrier 10. Due to its larger size, while in the storage and transport modes illustrated in FIGS. 19-22, the storage compartment 56 may also adapted to receive and hold a variety of articles while storing the collapsed item. As such, during the storage and transport modes (fifth mode) of the carrier 10 shown in FIGS. 19-22, the carrier 10 may also be configured for use in the holder mode during which a variety of articles may additionally be contained and carried in the small and large pouches (sixth mode).

By the foregoing construction, it will be appreciated that the main body 13 of the carrier 10 is provided with two pouches (i.e., a small pouch and a large pouch) formed of the top panels 12 and 14 and the base panel 16 fixedly attached together, with each pouch being formed with a closed bottom and sides and with an open top (opening) opposite to the closed bottom for providing access into the corresponding storage compartment 56, 58. The large pouch (i.e., formed of the top panel 14 and base panel 16) includes the closure flap 18 fixedly attached along the edge 18*d* to the base panel 16 and arranged to extend over the open top for releasably fastening to the top panel 14 by means of hook and loop patches 46, 48 as described above. One or both of the large and small pouches may include at least one drain hole in a bottom portion of the corresponding storage compartment in order to avoid any undesired collection of liquid in the compartments. The pouches may also include air flow openings (e.g., using grommets, perforated screens, etc.) to maintain the interior of the storage compartments aerated.

According to another feature of the present invention, the strip 38 defines a horizontal folding zone of the main body 13 about which the large and small pouches can be conveniently and readily folded relative to one another during use of the carrier 10 in the various modes. For example, when the carrier 10 is used in the accessory mode (second mode) as an accessory for a portable chair of the collapsible type, such as folding chair 150 shown in FIG. 15, the large and small pouches can be easily folded relative to one another about the horizontal folding zone so that the carrier 10 can be readily arranged to slip over and at least partially cover a back rest 152 of the folding chair 150, with the large and small pouches lying on opposite sides of the back rest 152 and the horizontal folding zone disposed generally over and at least partially resting on a top rail of the back rest 152. Furthermore, when the carrier 10 is used in the accessory mode as an accessory for a portable durable medical device of the collapsible type, such as a collapsible walker 350 shown in FIG. 17, the large and small pouches can be easily folded relative to one another about the horizontal folding zone so that the carrier 10 can be readily arranged to slip over a horizontal interconnecting brace 365 of the walker 350, with the large and small pouches lying on opposite sides of the brace 365 and the horizontal folding zone disposed generally over and at least partially resting on the brace 365.

Figure 15:
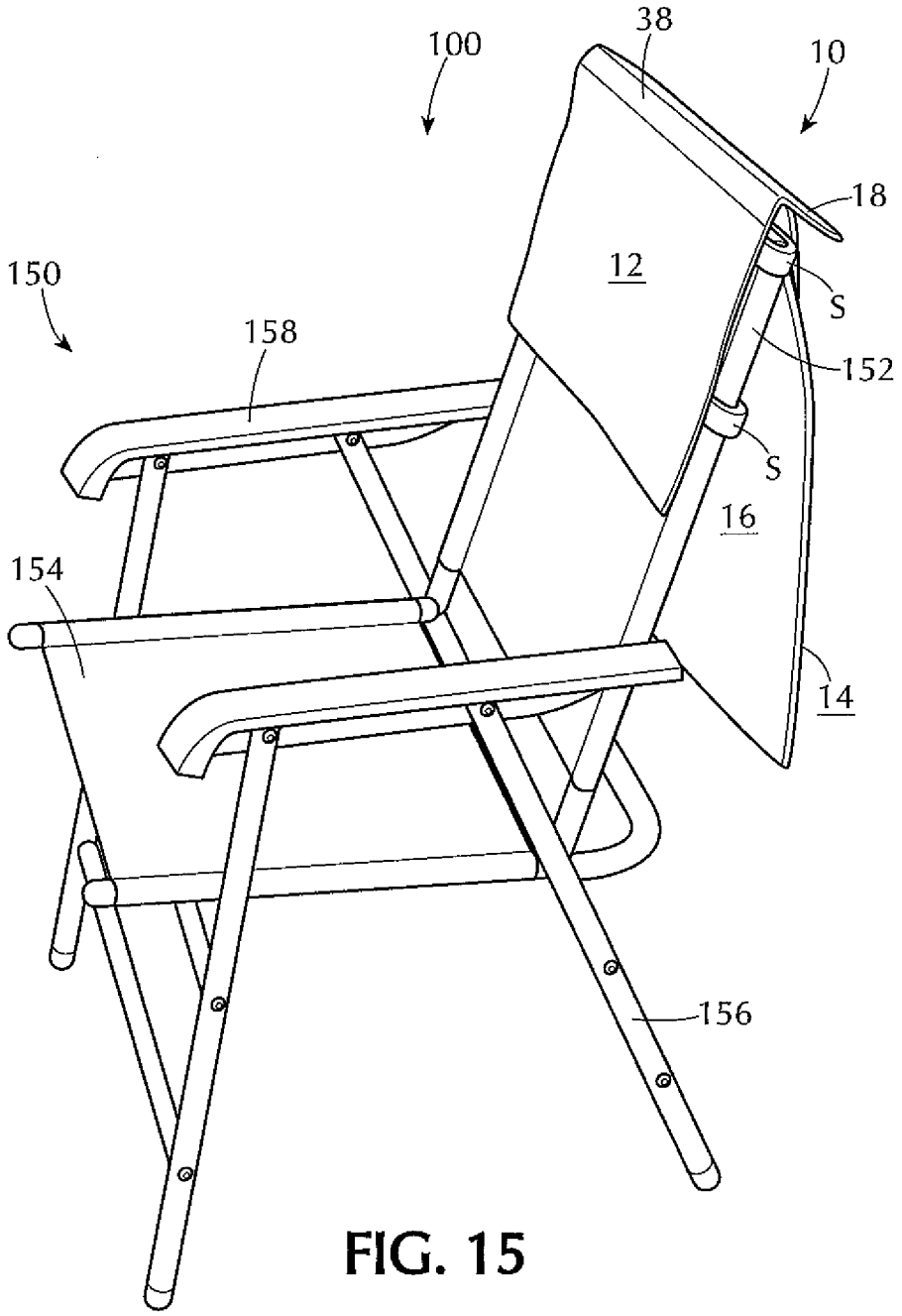
FIG. 15 is a front perspective view showing the multipurpose carrier according to the present invention during use in a holding mode as an accessory to one type of portable chair of the collapsible type.
Figure 16:
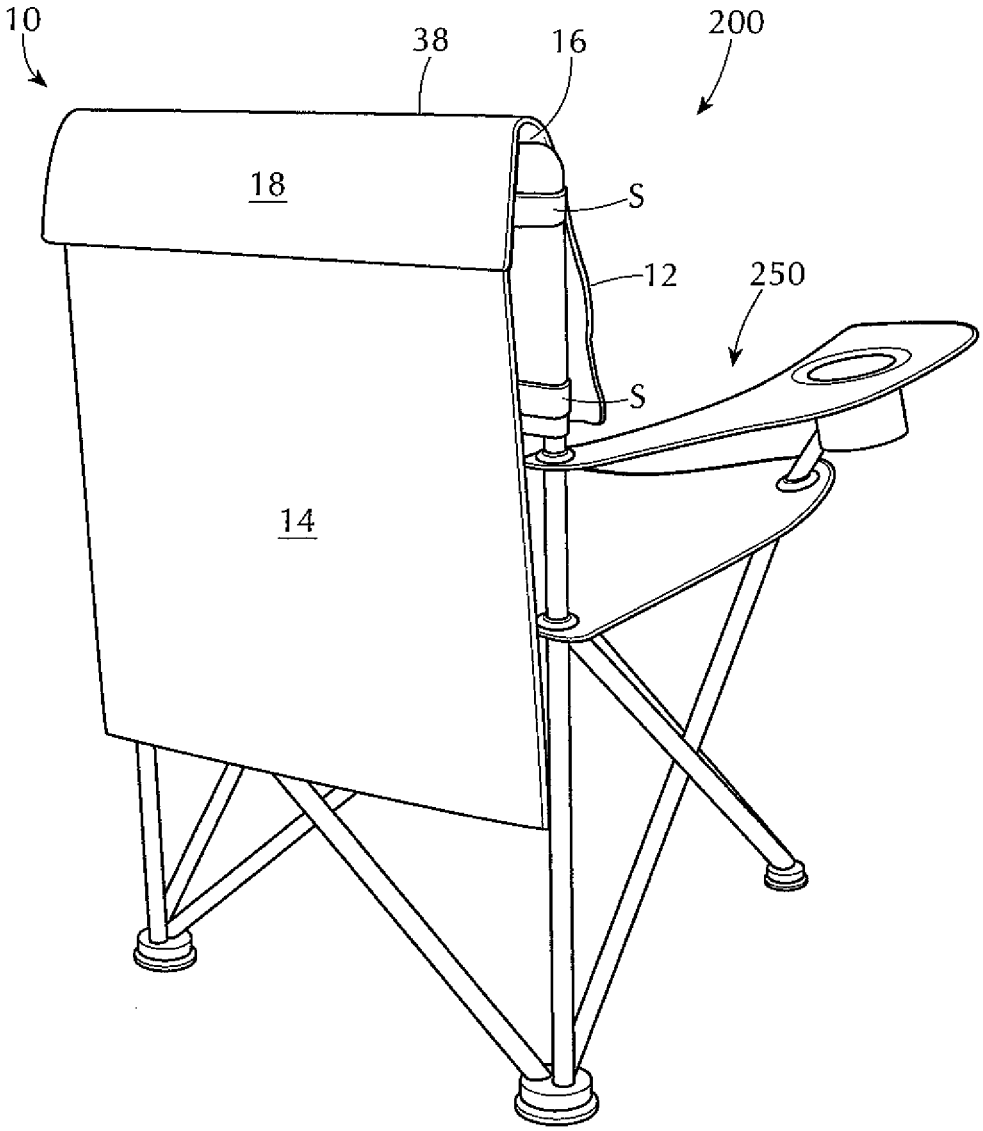
FIG. 16 is a rear perspective view showing the multipurpose carrier according to the present invention during use in a holding mode as an accessory to another type of portable chair of the collapsible type.
Figure 17:
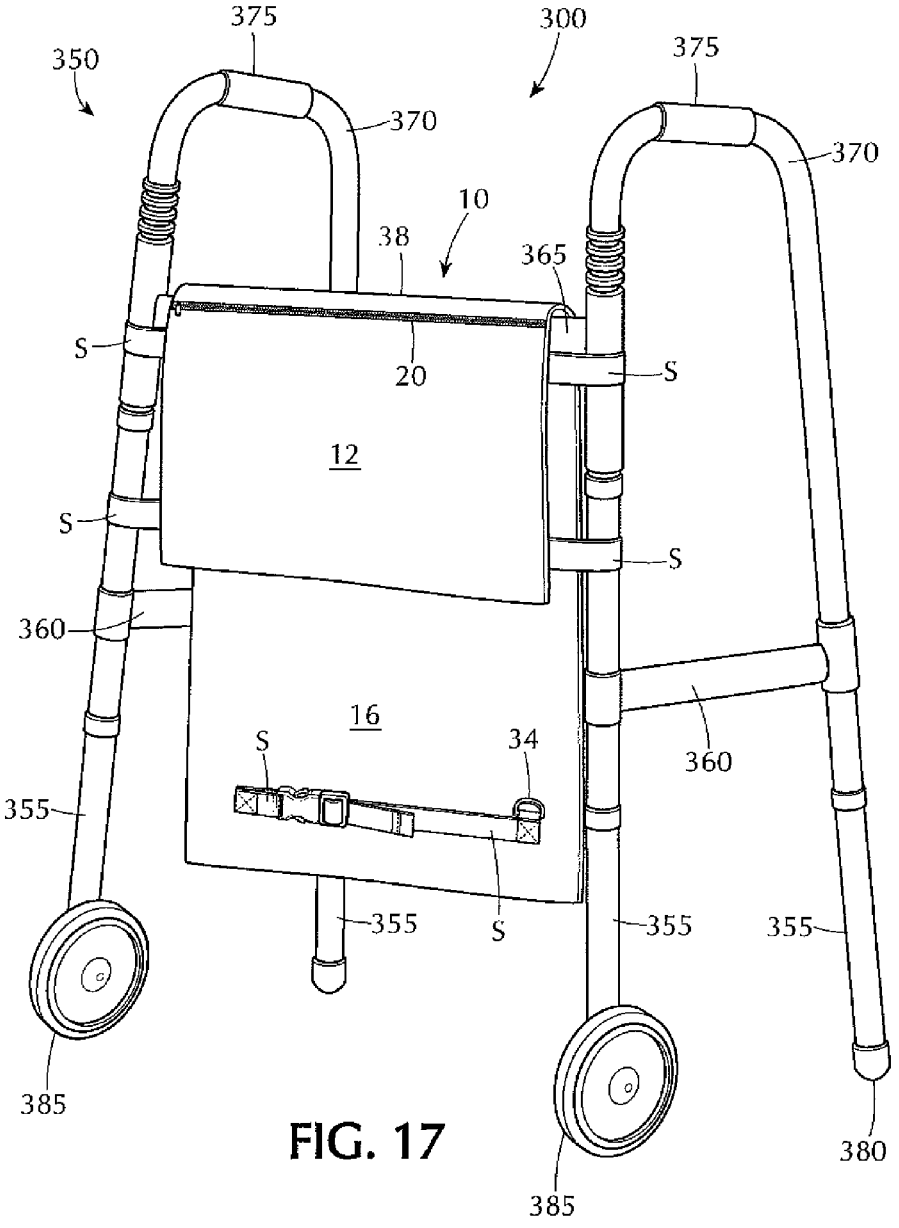
FIG. 17 is a perspective view showing the multipurpose carrier according to the present invention during use in a holding mode as an accessory to a durable medical device in the form of a portable walker of the collapsible type.

Thus in the accessory modes of the carrier 10 shown in FIGS. 15 and 17, each of the top rail 152 (FIG. 15) and the brace 365 (FIG. 17) engages, at least in part, the horizontal folding zone of the multipurpose carrier. Each of the top rail 152 and the brace 365 therefore defines a support member for at least partially supporting the multipurpose carrier in the accessory mode. Additionally, in each of the accessory modes of the carrier 10 shown in FIGS. 15 and 17, the openings of the small and large pouches are readily and conveniently accessible to the user for inserting into the storage compartments a variety of articles which may be safely and conveniently stored therein, as well as being readily and conveniently accessible for removing such articles from the storage compartments. FIG. 16 also shows the carrier 10 during use in the accessory mode, but as an accessory for a portable chair of the collapsible type 250 different from the chair 150 shown in FIG. 15.

Referring now to FIGS. 1-3 and 11, the bottom surface of the base panel 16 corresponding to the rear side of the main body 13 is provided with a connection assembly including four cooperating sets of side-pinch, quick action connecting elements fixedly secured to attachment regions A1, A2, B1, B2, C1, C2, D1 and D2 provided on the bottom surface of the base panel 16. The connecting elements comprise buckle arrangements with male ends 22*a*, 24*a*, 26*a*, 28*a* and female ends 22*b*, 24*b*, 26*b*, 28*b* and respective connecting straps S fixedly secured (e.g., by sewing) to the bottom surface of the base panel 16 at the attachment regions A1, A2, B1, B2, C1, C2, D1 and D2 as shown in FIG. 11. The male ends of the buckle arrangements are adjustable by sliding the straps S through the buckle arrangements to adjust the length of the straps S. The adjustable feature of the connecting elements, including the ring-shaped elements described below, together with the particular locations of the attachment regions on the rear side of the main panel 13 to which the connecting elements are secured, allows the carrier 10 to be configured and adapted for use in the various modes (e.g., holder, accessory, storage and/or and transport modes) noted above and further described below with reference to FIGS. 15-22.

Also attached to the main body 13 are a first pair of ring-shaped members 30, 34 and a second pair of ring-shaped members 32*a*, 32*b*. Clips 44*a*, 44*b* provided at opposite ends of a carrying strap 44 (FIG. 3) are configured for removable attachment selectively to the first pair of ring-shaped members 30, 34 and the second pair of ring-shaped members 32*a*, 32*b* to removably secure the carrying strap 44 to the main body 13. A third pair of ring-shaped members 36*a* and 36*b* are also attached to the main body 13 for adjusting the length of the large pouch as further described below with reference to FIGS. 7-8. In this exemplary embodiment, the ring-shaped members are configured as eyelets, for example. It will be appreciated, however, that other types of fasteners and corresponding shapes are suitable for removably securing the carrying strap 44 to the main body 13.

Eyelets 30, 34 are pivotally mounted to attachment regions A2, D2, respectively, so as to be freely pivotable by about 180 degrees on the rear surface of the base panel 16. Eyelets 32*a*, 32*b* are pivotally mounted to and extend from respective portions of lateral side edges 19, 23 of the main body 13 corresponding to opposite ends of the strip (horizontal folding zone) 38 and are preferably centered along the central axis 38*a* (FIG. 11) of the strip 38. That is, eyelets 32*a*, 32*b* are pivotally mounted to respective opposite ends of the horizontal folding zone defined by the strip 38 so as to be freely pivotable by about 180 degrees between the bottom surface of the base panel 16 (corresponding to the rear side of the main body 13) and a top surface of the closure panel 18 (corresponding to the front side of the main body 13). The eyelets 36*a*, 36*b* are pivotally mounted to and extend from portions of the longitudinal end 17 of the main body 13 so as to be freely pivotable by about 180 degrees between the bottom surface of the base panel 16 and a top surface of the panel 14. As further described below with reference to FIGS. 7-8, the eyelets 36*a*, 36*b* are configured for engagement with fasteners 50, 52 (e.g., hook and loop strips), respectively, secured at opposite sides of the patch 48 for adjusting the size of the large pouch by folding a lower portion of the pouch toward the closure panel 18. Each of the eyelets 30, 32*a*, 32*b*, 34, 36*a* and 36*b* is pivotally mounted to the bottom surface of the base panel 16 (i.e., the rear side of the main body 13) as described above by a tether fixedly secured to the main body 13, such as by sewing.

FIG. 3 is a rear view of the carrier 10 similar to the carrier 10 shown in FIG. 2, except that FIG. 3 further illustrates the clips 44*a*, 44*b* of the carrying strap 44 removably attached to eyelets 30, 34, respectively, which are fixedly secured to attachment regions A2, D2 of the base panel 16 as described above. By attaching the carrying strap 44 to the eyelets 30, 34 in this manner, the carrier 10 may be readily configured and adapted for use in the storage and transport modes (fifth mode) for storing and carrying the portable chair of the collapsible type 250 in its collapsed state, as illustrated in FIGS. 19-22.

Figure 18:
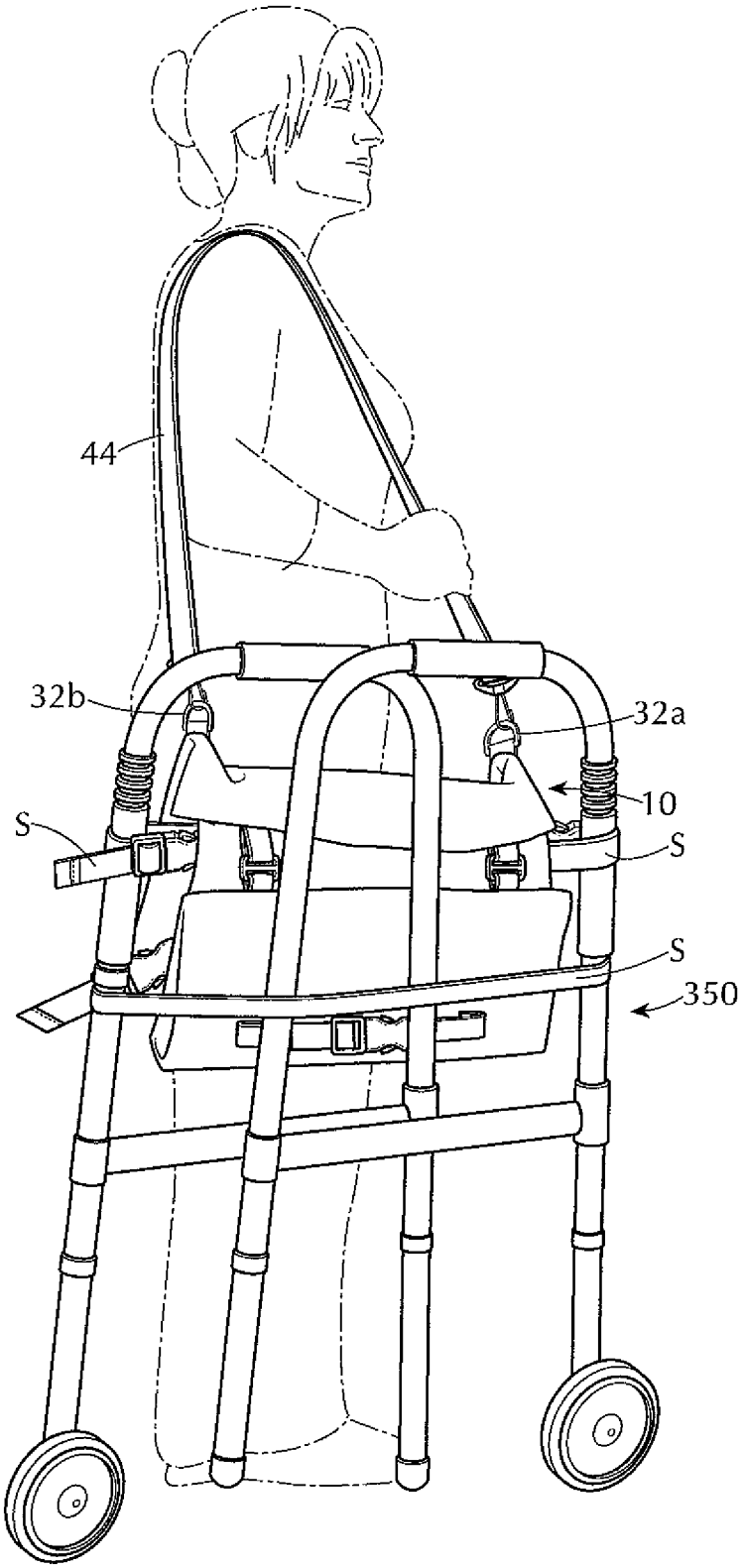
FIG. 18 is a perspective view showing the multipurpose carrier according to the present invention during use in a holding mode and a transport mode in combination with the walker shown in FIG. 17.

In another embodiment, the clips 44*a*, 44*b* of the carrying strap 44 are removably attached to eyelets 32*a*, 32*b*, respectively, secured at opposite ends of the strip 38 (folding zone), thereby configuring and adapting the carrier 10 for use in the transport mode (fourth mode) for transporting a portable durable medical device of the collapsible type, such as a walker 350 in the collapsed state as shown in FIG. 18. In the transport mode shown in FIG. 18, various articles may be held and carried within the storage compartments of the small and large pouches. As such, FIG. 18 is also representative of the carrier 10 being configured and adapted for use in both the holder and transport modes (sixth mode).

It will be appreciated from the illustration in FIG. 18 that upon removal of the collapsed walker from the carrier 10 by releasing the selected buckle arrangements including straps 8, the configuration of the carrier 10 and the manner in which the carrier 10 is being held by the user as shown in FIG. 18 is also representative of the carrier 10 being used in the holder mode during which the carrier is configured and adapted for use independently as a bag, tote or backpack for holding a variety of articles in the storage compartments.

It will be also appreciated that instead of providing for the removable attachment of the carrying strap (s) to eyelets attached to the main body 13, the carrying straps) may be fixed directly to the main body 13 by any known means, including sewing and fasteners. Furthermore, although not shown, a cushioning pad with a non-slip grip may be attached to carrying strap at its approximate midpoint as known in the art to that the impingement of the carrying strap on the individual is lessened. Additionally, various hand holds or handles (not shown) may be selectively secured to the main body 13 for handling the carrier 10 during use.

Figure 19:
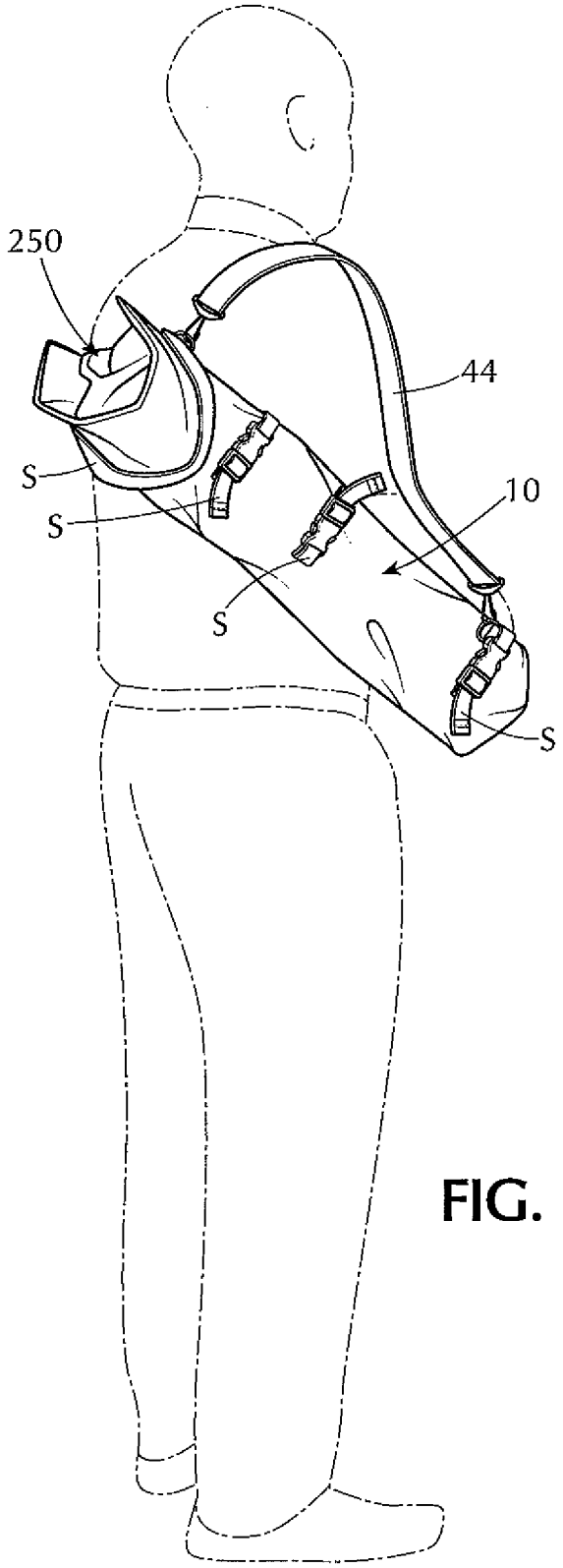
FIG. 19 is a perspective view showing the multipurpose carrier according to the present invention during use in holding, storage and transport modes in combination with a portable chair of the collapsible type.

Preferably, the connecting straps S, carrying strap 44 and tethers are made of a suitable webbing material, such as tough nylon seatbelt webbing, and the buckles, carrying strap clips and eyelets are made of a suitable hard material, such as metal, hard plastic, composite material and combinations thereof. The dimensions of the connecting straps S and carrying strap 44 may be selected as desired for the particular use of the carrier 10 as described herein. In a preferred embodiment, the strap S corresponding to the fastener 22*a* has a length of about 36 inches, and each strap S corresponding to the fasteners 24*a*, 26*a* and 28*a* has a length in the range of about 16 inches to about 18 inches. Although not shown in the figures, each of the straps S corresponding to the fasteners 22*b*, 24*b*, 26*b* and 28*b* is folded in half with the free ends fixedly secured to the corresponding attachment region on the main body 13 to form a loop to which the corresponding fastener is mounted. In the preferred embodiment, the folded length (i.e., distance from connection to the attachment point to the point of attachment to the fastener) of each strap S corresponding to the fasteners 22*b*, 24*b*, 26*b* and 28*b* is about 3 inches (i.e., each strap S is about 6 inches in length). The carrying strap 44 is selected with dimensions sufficient so that the carrier 10 can be transported either at the side of the individual or over the shoulder (as shown in FIGS. 18 and 19). Preferably, the carrying strap 44 has a width in the range of about 0.75 to about 2.0 inches and a length that is at least about 6 inches longer than the distance between the attachment points, which in the embodiment of FIG. 3 corresponds to the distance between eyelets 30, 34 in the direction of the length a (FIG. 10) of the main body 13.

Various dimensions, distances and corresponding positional relationships of the various components of the carrier 10 according to a preferred embodiment of the invention are described below with reference to FIGS. 10-13.

FIG. 10 is a top view of the carrier 10 showing various dimensions and corresponding positional relationships relating to the panels 12, 14, 16 and 18. For clarity of illustration only, components of the carrier 10 other than panels 12, 14, 16 and 18, including certain connecting elements, have been omitted from FIG. 10. As described above, dimensions a and b denote the length and width, respectively, of each of the main body 13 and the base panel 16. Dimension b also denotes the width of each of the top panels 12, 14 and 18. Dimensions c, d and g denote the lengths of top panels 14, 12 and 18, respectively, in the direction of length a. Dimension e denotes the distance in the direction of the length a between the stitch line 42 and the edge 18*b* of the panel 18. Dimension f denotes the distance between the zipper 20 and the stitch line 42 which corresponds to the length of the strip 38 in the direction of the length a of the main body 13. Dimension h denotes the distance in the direction of the length a between the zipper 20 and the fourth end 14*d* of the top panel 14.

FIG. 11 is a bottom view of the carrier 10 showing various dimensions and corresponding positional relationships relating to attachment regions A1, A2, B1, B2, C1, C2, D1 and D2, eyelets 30, 34, eyelets 32*a*, 32*b* (FIG. 2), eyelets 36*a*,36*b*, and base panel 16. For clarity of illustration only, the various connecting elements of the connector assembly corresponding to the buckle arrangements, including straps S, have been omitted from FIG. 11 for clarity of illustration only. Dimensions a and b denote the length and width, respectively, of the base panel 16 as well as the overall main body 13, as described above. Dimension i denotes the distance in the direction of the length a of the main body 13 between the longitudinal end 15 of the main body 13 and the centerline 38*a* of the strip 38. Dimension j denotes the distance in the direction of the length a between the longitudinal end 15 and the attachment region C2. Dimension k denotes the distance in the direction of the length a between the longitudinal end 15 and the attachment region B2. Dimension l denotes the distance in the direction of the length a between the longitudinal end 15 and the attachment region A2. Dimension m denotes the distance in the direction of the length a between the attachment regions A2 and B2. Dimension n denotes the distance in the direction of the length a between the attachment regions B2 and C2. Dimension o denotes the distance in the direction of the length a between the longitudinal end 17 and the attachment region D2. Dimension p denotes the distance in the direction of the width b between the lateral side edge 19 of the main body 13 and the attachment region D2. Dimension q denotes the distance in the direction of the width b between the lateral side edge 23 of the main body 13 and the attachment region D1.

Attachment regions A2, B2, C2 and D2 are aligned relative one another along a common central axis (not shown) extending in the direction of the length a. Attachment regions A1, B1, C1 and D1 are aligned relative one another along a common central axis (not shown) extending in the direction of the length a. Attachment regions A1 and A2 are aligned relative one another along a common central axis (not shown) extending in the direction of the width b. Attachment regions C1 and C2 are aligned relative one another along a common central axis (not shown) extending in the direction of the width b. Attachment regions D1 and D2 are aligned relative one another along a common central axis (not shown) extending in the direction of the width b. By the foregoing positional arrangement of the attachment regions on the bottom surface of the base panel 16 (corresponding to the rear side of the main body 13), as shown in FIG. 11, it will be appreciated that without taking the buckle arrangements, straps, and eyelets 30, 34 into consideration, the main body 13 is substantially symmetrical about a central axis extending along the direction of the length a of the main body 13.

FIGS. 12A-12B and 13 show similar and additional dimensions and positional relationships relating to components of the carrier 10. FIG. 12A is a top view of the main body 13 without the closure panel 18, and FIG. 12B is a top view of the closure panel 18. With reference also to the dimension h shown in FIG. 10, FIG. 12A shows the manner in which the top panels 12 and 14 are secured to the base panel 16 so as to provide a space denoted by the dimension h extending along the direction of the length a between the side 12*d* of the top panel 12 and the side 14*d* of the top panel 14. This space between top panels 12 and 14 exposes a portion of the top surface of the base panel 16 and facilitates insertion of items into the large pouch 56 when the closure flap 18 is opened during use of the carrier 10. FIGS. 12A-12B also show the positioning of the hook and loop patches 46, 48 at general central regions of the closure panel 18 and top panel 14, respectively, in the direction of the width b of the main body 13, as denoted by each of dimensions b1, b2 which in the exemplary embodiment corresponds to about one-half the width b. The exploded view shown in FIG. 13 also shows relevant dimensions of the panels 12, 14, 16 and 18 and corresponding positional relationships relating to the patches 46, 48 and the eyelets 32*a*, 32*b* and 36*a*, 36*b* as described above with reference to FIGS. 10-12.

The specific values for the various dimensions of the carrier 10 shown in FIGS. 10-13 are selected to achieve dimensional relationships suitable for configuring and adapting the carrier 10 to the various modes described herein as well as to other modes within the scope of the invention disclosed herein. Table I below illustrates an example of preferred ranges of dimensions for the components forming the carrier 10 as described above with reference to FIGS. 10-13. For example, during use of the carrier 10 in the holder, accessory, storage and transport modes shown in FIGS. 15-22, the dimensions within the ranges shown in Table I below are particularly adapted for use of the carrier 10 with an appropriately sized portable chair or walker of the collapsible type.

TABLE I

| DIMENSION | DIMENSION RANGE |
|---|---|
| a | 30½ to 32½ inches |
| b | 16 to 18 inches |
| b1 | 8 to 9 inches |
| b2 | 8 to 9 inches |
| c | 18½ to 20½ inches |
| d | 9 to 11 inches |
| e | 2½ to 4½ inches |
| f | ½ to 1½ inches |
| g | 3½ to 5½ inches |
| h | 1½ to 2½ inches |
| i | 10 to 12 inches |
| j | 11½ to 14½ inches |
| k | 7½ to 9½ inches |
| l | 2 to 4 inches |
| m | 4½ to 6½ inches |
| n | 4½ to 6½ inches |
| o | 4 to 6 inches |
| p | 3 to 4 inches |
| q | 3 to 4 inches |

In one particularly preferred embodiment of the carrier 10 of the invention during use in the holder, accessory, storage and transport modes shown in FIGS. 15-22 in combination with a chair of the collapsible type, for example, the values of dimensions a, b, c, d and h shown in FIGS. 10-12 and corresponding to the main body 13, the small pouch formed by the panel 12 and the base panel 16, the large pouch formed by the panel 14 and the base panel 16, and the gap (strip/folding zone) between the small pouch and the large pouch are selected to be about 31½ inches, 17 inches, 19½ inches, 10 inches, and 2 inches, respectively. For larger chairs of the collapsible type, for example, the length of the large pouch should preferably be at least one-half the height of the chair. It will be appreciated that the foregoing dimension ranges can be modified to configure the carrier 10 for use with chairs and/or durable medical equipment of differing dimensions with the use of suitable connecting elements and fasteners (e.g., adjustable straps, buckles, hook and loop connectors, snaps) as described above.

Figure 7:
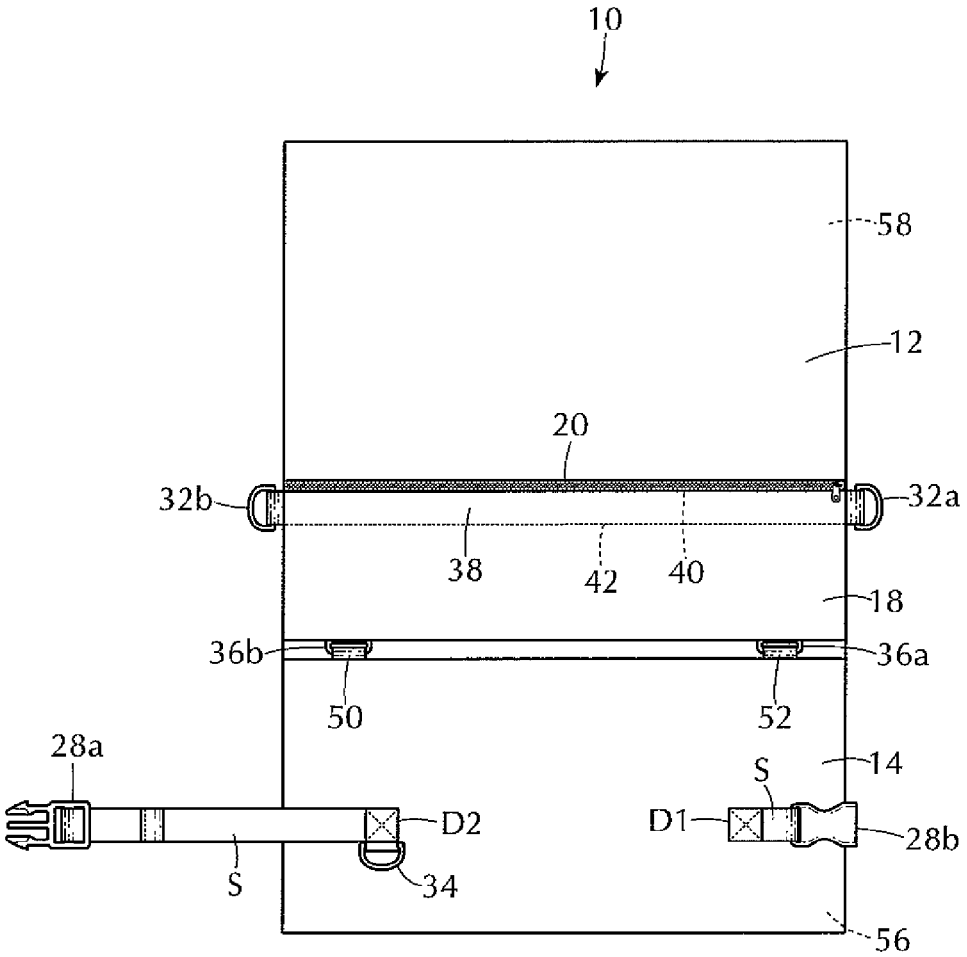
FIG. 7 is a front view of the multipurpose carrier according to the present invention illustrating an exemplary manner of adjusting the size of the first pouch and with a closure panel for the first pouch shown in a closed position.
Figure 8:
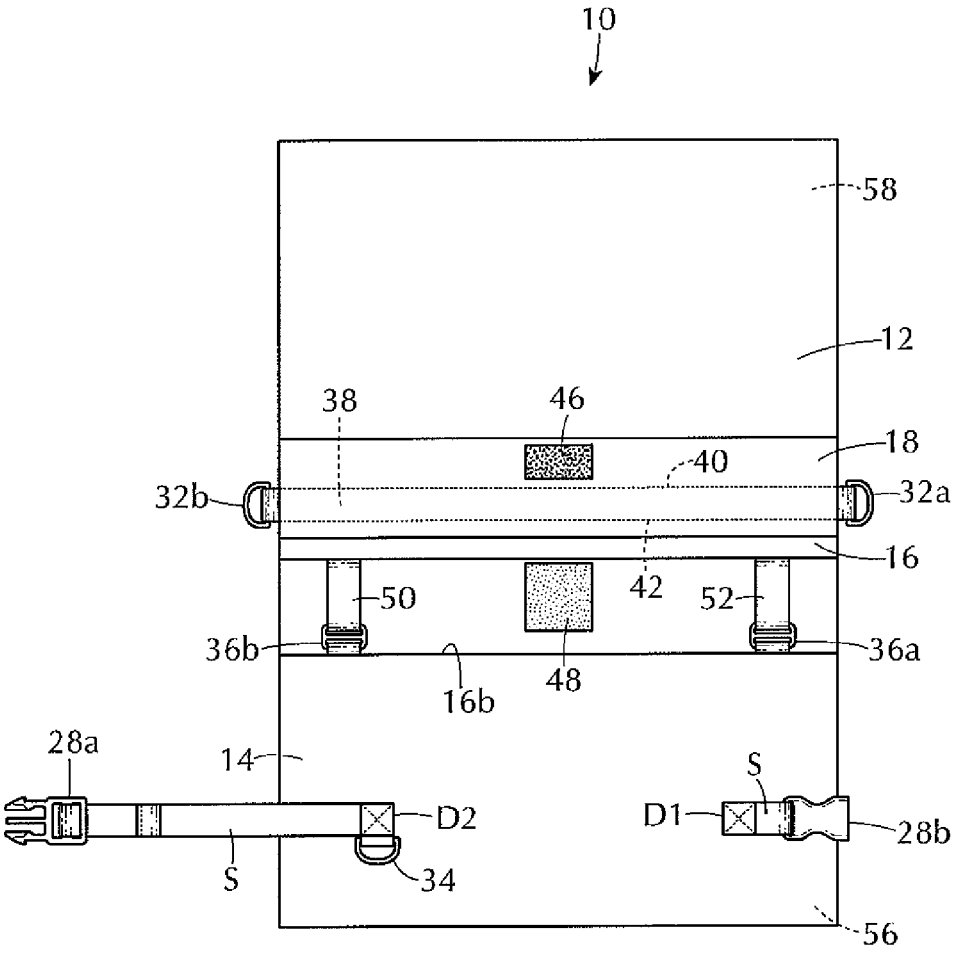
FIG. 8 is a view similar to FIG. 7 but with the closure panel in an open position to show a fastening system including fastening elements for the closure panel and fastening elements used to adjust the size of the first pouch.

FIGS. 7-8 show a configuration of the carrier 10 illustrating an adjustable feature of the large pouch. FIG. 8 shows the carrier 10 with the closure panel 18 open (i.e., the patch 46 of the closure panel 18 is disengaged from the patch 48 of the top panel 14). The size of the large pouch is adjusted (i.e., reduced) by folding it from the side lob toward the closure panel 18 and engaging the fasteners 50, 52 on the base panel 16 with the eyelets 36*b*, 36*a*, respectively. FIG. 7 shows the carrier 10 with the adjusted large pouch and the closure panel 18 closed. Preferably, the fasteners 50, 52 are hook and loop fasteners, however, other types of fasteners are suitable including, but not limited to, buckles and snaps. By reducing the large pouch as set forth above, access into the storage compartment of the large pouch is facilitated in that the bottom of the storage compartment in the large pouch is raised by an amount corresponding to the adjusted size of the large pouch, effectively shortening the distance necessary to reach the bottom of the storage compartment. This configuration of the carrier 10 is particularly adapted to assist patients with limited mobility by further facilitating access into the storage compartment of the large pouch as described above.

In an exemplary embodiment, the configuration of carrier 10 with the adjusted large pouch shown in FIGS. 7-8 is suitable for use of the carrier 10 in the transport mode (fourth mode), as shown in FIG. 18, during which the carrier 10 is used to transport the walker 350 in the collapsed state, as well as in the holder mode in combination with the transport mode (sixth mode) during which various articles may be stored within the small and large pouches while the walker 350 in the collapsed state is being transported by the user using the carrier 10. In the configuration shown in FIG. 18, the clips 44*a*, 44*b* of the carrying strap 44 are attached to the eyelets 32*a*, 32*b*, respectively, either before or after the small pouch is folded relative to the large pouch about the folding zone. The walker 350 in the folded state can then be transported by carrier 10 by placing the carrying strap 44 over the user's shoulder in the manner shown in FIG. 18.

In another exemplary embodiment, the configuration of carrier 10 with the adjusted large pouch shown in FIGS. 7-8 is also suitable for using the carrier 10 in the holder mode (first mode) during which the carrier 10 is used independently as a bag or tote for holding various articles within the small and large pouches, including books and electronic equipment. In this holder mode of the carrier 10, the clips 44*a*, 44*b* of the carrying strap 44 are attached to the eyelets 32*a*, 32*b*, respectively, either before or after the small pouch is folded relative to the large pouch about the folding zone. The carrier 10 can then be carried by placing the carrying strap 44 over the user's shoulder. This holder mode of the carrier 10 may be readily appreciated from the configuration of the carrier 10 shown in FIG. 18 when the walker is removed from the carrier 10.

Figure 9:
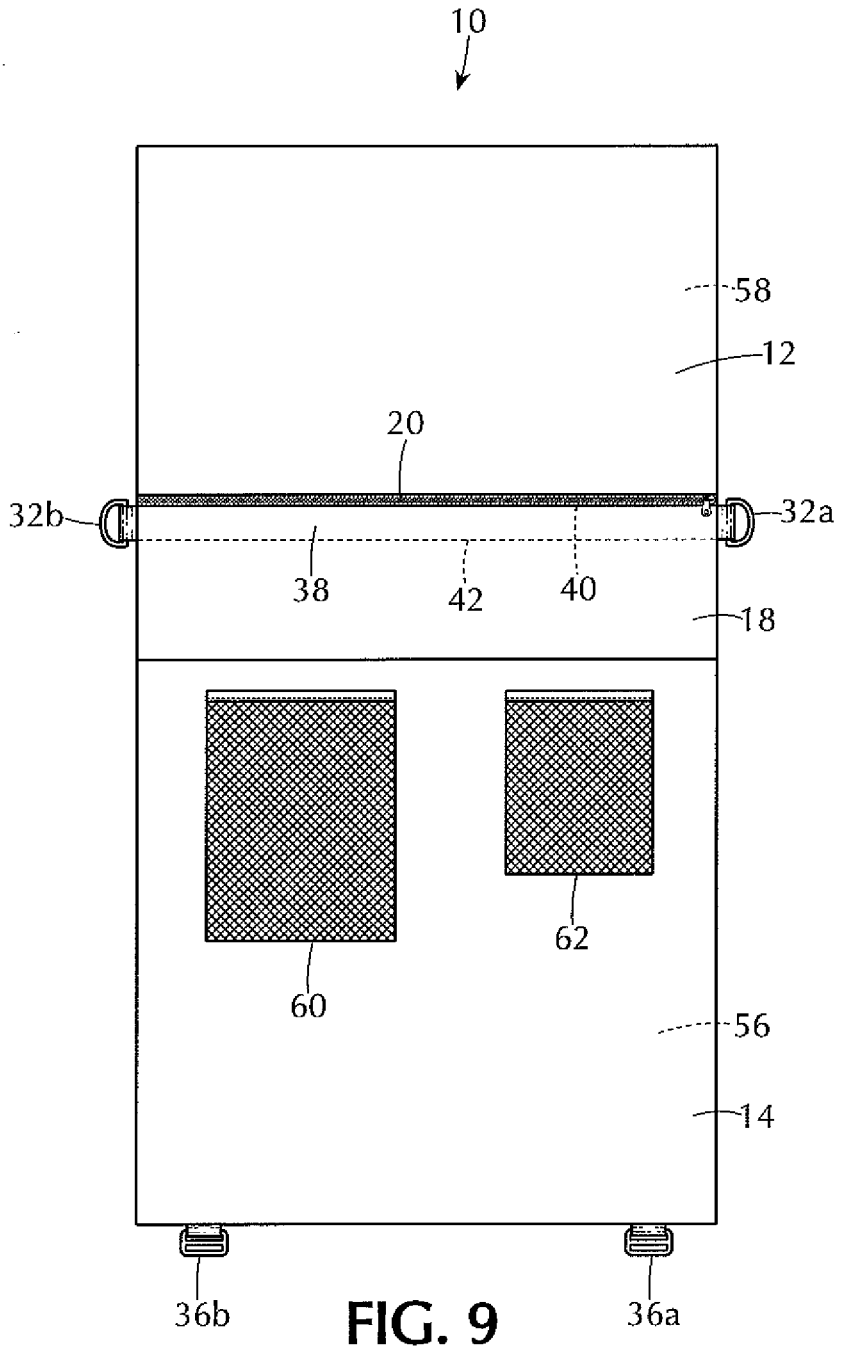
FIG. 9 is a front view of the multipurpose carrier according to another embodiment of the present invention with certain connecting elements omitted for clarity of illustration.

FIG. 9 shows a modified form of the carrier 10 according to the present invention. In FIG. 9, the carrier 10 is further provided with pockets 60 and 62 of different sizes on the outer surface of the top panel 14. The larger pocket 60 may be used for storing various sized containers including, but not limited to, beverage containers and small portable oxygen tanks. The smaller pocket 62 may be used for storing smaller items including, but not limited to, calendars, cell phones, cameras, remotes and related items and accessories. Pockets 60, 62 may be formed of suitable mesh material or a material similar to that used for the panel 14. Pockets 60, 62 may also be provided with closure flaps (not shown), which may include releasable fastening means. Alternatively, one or both of the pockets 60, 62 may be fitted with a drawstring to keep the pocket(s) closed. Additionally, although two pockets 60, 62 of different sizes are shown in FIG. 9, one pocket or more than two pockets of equal or different sizes may be provided, and the pockets 60, 62 may be provided on surfaces of the carrier 10 other than or in addition to the surface of the top panel 14.

FIGS. 15-22 illustrate the various exemplary modes to which the multipurpose carrier 10 according to the present invention may be configured. FIGS. 15 and 16 show configurations 100, 200, respectively, showing the carrier 10 during use in the accessory mode (second mode) as an accessory for portable chairs of the collapsible type 150, 250. FIG. 17 shows a configuration 300 showing the carrier 10 during use in the accessory mode (second mode) as an accessory for a portable walker 350 of the collapsible type. FIG. 18 shows the carrier 10 during use in the transport mode (fourth mode) for transporting the walker 350 of the collapsible type in the collapsed state. FIGS. 19-22 show the carrier 10 configured in the storage and transport modes (fifth mode) during which the carrier stores and transports a portable device of the collapsible type, such as the portable chair of the collapsible type 250.

In the configuration 100 shown in FIG. 15, the portable chair 150 includes a back rest 152, a seat portion 154, support legs 156 and arm rests 158. The carrier 10 is releasably engaged with the chair 150 by folding the small pouch relative to the large pouch about the strip (horizontal folding zone) 38 and arranging the carrier 10 to slip over and at least partially cover the back rest 152 of the chair 150 with the small pouch lying over a front surface of the back rest 152 and the large pouch lying over a rear surface of the back rest 152. When the carrier 10 is arranged relative to the chair 150 in this manner, the horizontal folding zone is disposed generally over and at least partially rests on a top rail of the back rest 152. The carrier 10 is secured to the back rest 152 of the chair 150 using the connection assembly described above with reference to FIG. 2 by wrapping corresponding straps S around selected structural elements (e.g., back of chair, tubular support members), buckling in place using the buckle arrangements (e.g., male/female ends 22*a*, 22*b*, 24*a*, 24*b*, 26*a*, 24*b*), and tightening the straps S. By this arrangement and manner of connection, the carrier can be securely stabilized relative to the chair 150. The stabilization of the carrier 10 relative to the chair 150 using the selected connecting elements prevents the carrier 10 from sliding relative to the chair 150 and insures proper positioning of the small and large pouches of the carrier 10 relative to the chair 150, such as shown in FIG. 1, so that continued access into the storage compartments of the pouches is maintained and facilitated during use.

With the carrier 10 secured to the chair 150 as shown in FIG. 15 and described above, a variety of articles and items may be readily inserted into and removed from the storage compartments of the small and large pouches by way of the openings of the pouches. This is particularly achieved by the unique configuration of the carrier 10 that results in the openings of the pouches being conveniently and readily accessible during use of the carrier 10 when the carrier 10 is arranged over the chair 150, as shown in FIG. 15, so that the horizontal folding zone is disposed generally over and at least partially rests on the top rail of the back rest 152 with the small pouch and the large pouch being disposed on and extending along opposite surfaces of the back rest 152. Since the carrier 10 can be made of water-resistant materials, the items (e.g., reading material) can be safely stored within the storage compartments of the small and large pouches.

In the configuration 200 shown in FIG. 16, the carrier 10 is used as an accessory for the portable chair of the collapsible type 250 in substantially the same manner as described above for the configuration 100 in FIG. 15, including using the various connecting elements (e.g., straps S) to securely and removably mount the carrier 10 to the portable chair 250. It will be readily appreciated that the portable chair 250 is of a collapsible type different from that of the portable chair 150 (i.e., a folding chair) shown in FIG. 15. Specifically, the collapsible portable chair 150 is of a folding type which is configured to be collapsed (i.e., fold) in only one direction, whereas the collapsible portable chair 250 is configured to be collapsed in multiple directions. As such, the portable chair 250 is particularly adapted to be completely stored in and transported by the carrier 10 when configured in the storage and transport modes (fifth mode) as described below with reference to FIGS. 19-22.

From the foregoing exemplary configurations shown in FIGS. 15 and 16, it will be appreciated that the multipurpose carrier 10 is readily configurable and adapted for use in the accessory mode (second mode) for arrangement relative to a portable chair of the collapsible type to permit various articles and items to be conveniently inserted into and removed from the storage compartments of the small and large pouches. This is particular achieved by the advantageous arrangement of the carrier 10 relative to the chair which makes the openings of the small and large pouches readily accessible to the user. The pouches of the carrier 10 configured in the accessory mode shown in FIGS. 15 and 16 are ideal for use at sporting events or camping trips by providing storage for reading material, event programs, climate gear, etc. It will be appreciated that the multipurpose carrier 10 can be used with chairs other than the portable collapsible chairs 150, 250 described above with reference to FIGS. 15 and 16, including collapsible chairs without top rail construction, fixed width stadium folding seats, and other types of seating and lounging chairs structures (either collapsible or fixed), such as a fixed back chair or a chair with a foldable back. Alternatively, the multipurpose carrier 10 can be used with chairs that are neither portable nor collapsible. The multipurpose carrier 10 can also be used with seating and lounging chair structures made of various materials (e.g., metal, wood, plastic), constructions (e.g., not limited to tubular construction) and dimensions.

It will also be appreciated that the multipurpose carrier 10 in each of FIGS. 15 and 16 is configured with one or more unobstructed panels for use as an advertising opportunity, making the multipurpose carrier particularly suitable for use as a promotional item. More specifically, when the carrier 10 is attached to the collapsible chairs 150, 250 as described above with reference to FIGS. 15 and 16, the panels 14 and 18 hang straight down due to the force of gravity, even when the chair is in an inclined position, and are unobstructed from view, making the panels 14 and 18 highly visible at all times. These highly visible panels provide ideal locations for branding and personalizing, including the placement of various types of advertising indicia. As such, the carrier 10 is also particularly adapted for use as an advertising device which corresponds to one of the aspects of the present invention.

In the configuration 300 shown in FIG. 17, the walker 350 is of a conventional type and includes four vertically directed space legs 355 which are interconnected to one another by lower 360 and upper 365 horizontal interconnecting braces. The upper ends of the legs 355, on opposite sides thereof, include a generally U-shaped handle 370, and handle grips 375 are mounted thereon to enable a user to grip and manipulate (e.g., lift) the walker 350 for balance and supported walking movements. At the lower ends, two of the legs 355 are each provided with a wheel 385 while the other two legs 355 are each provided with an end cap 380.

The multipurpose carrier 10 in the configuration 300 shown in FIG. 17 is configured and adapted for use in the accessory mode (second mode) similar to the accessory modes described above for the configurations 100 and 200 described above with reference to FIGS. 15 and 16.

To configure the carrier 10 in the accessory mode as shown in FIG. 17, the main body 13 is arranged to slip over the upper horizontal interconnecting brace 365 of the walker 350 by folding the large and small pouches corresponding to the first and second sections of the main body 13 relative to one another about the strip 38 (folding region) to position the pouches on opposite sides of the horizontal interconnecting brace 365 and with the folding region at least partially resting on the horizontal interconnecting brace 365. In this state, the main body 13 is releasably secured to legs 355 of the walker 350 by using selected ones of the connecting members (e.g., male/female ends 22*a*, 22*b*, 24*a*, 24*b* of buckle arrangements and corresponding straps S) of the connector assembly described above with reference to FIG. 2.

In the secured state of the walker 350 relative to the walker 350 as shown in FIG. 17, the small pouch is disposed on the outside of the walker 350, and the large pouch is disposed on the inside of walker 350 so as to be in direct confronting relation to the patient during use of the walker 350. In this configuration, the small pouch and the large pouch hang generally straight down due to the force of gravity, thereby facilitating access to the openings of the small and large pouches and making the storage compartments readily and conveniently available for the insertion and removal of various articles into and from the storage compartments. Furthermore, as described above for the configurations 100, 200 in FIGS. 15 and 16, the panels of the carrier 10 in the configuration 300 shown in FIG. 17 include unobstructed surfaces (e.g., surfaces of the panels 12 and 16) which are ideal locations for branding and personalizing, including the placement of various types of advertising indicia for use as an advertising opportunity. As such, the multipurpose carrier 10 in the configuration 300 shown in FIG. 17 is also particularly adapted for use as an advertising device, and is particularly suitable for use as a promotional item.

In an alternative arrangement, the large pouch may be further adjusted in the manner described above with respect to the embodiment of FIGS. 7-8. As described above, this adjusted configuration of the carrier 10 is particularly adapted to assist patients with limited mobility by further facilitating access to the bottom of the storage compartment in the large pouch.

In the exemplary configuration shown in FIG. 17, the large pouch provides storage for medical assistance devices, large personal items, magazines, books, and electronic devices such as laptops, notebooks and related devices and accessories. The small pouch can be utilized as a secure storage for smaller personal items such as medical records/orders, medication, eyeglasses, cell phones, and various other types of items and accessories. The various stored items described above can be stored in the pouches while the walker is in use (i.e., in a non-collapsed state). Thus, the configuration of the carrier 10 according to the present invention shown in FIG. 17 minimizes the movement of the items during use of the carrier 10 and maintains the items secure and near the patient.

FIG. 18 is a side view in perspective illustrating the multipurpose carrier 10 uniquely configured for use either in only the transport mode (fourth mode), during which the carrier 10 is used to transport the walker 350 while no items or accessories are stored in the storage compartments of the pouches, or in a combined mode that includes both the holder transport and holder modes (sixth mode), during which the carrier 10 is used to transport the walker 350 while various articles belonging to the patient are stored in the storage compartments.

The configuration shown in FIG. 18 is attained by collapsing the walker 350 from the configuration 300 shown in FIG. 17 while the carrier 10 remains mounted over the horizontal brace 365. The connecting elements of the connection arrangement as described above with reference to FIG. 2, including male/female ends 22*a*, 22*b* of the buckle arrangements and corresponding straps S, are utilized to secure the collapsed walker 350 during transport, such as to prevent unintended opening of the legs 355 when placing the collapsed walker 350 in a vehicle. The carrying strap 44 is connected to the main body 13 of the carrier 10 by attaching the clips 44*a*, 44*b* to the eyelets 32*a*, 32*b*, respectively. The collapsed walker 350 can be transported hands free by an assistant of the patient by placing the holder strap 44 on the assistant's shoulder while the carrier 10 remains mounted on the walker 350, as shown in FIG. 18. This unique mode of the carrier 10 according to the present invention particularly allows the assistant to aid the patient with ingress/egress to transportation vehicles or going up and down steps, for example.

In the configuration shown in FIG. 18, the carrier 10 is shown in the adjusted configuration as described above with reference to FIGS. 7-8. It is understood, however, that the transport mode and/or combined transport and holder modes illustrated in FIG. 18 can be equally realized without the large pouch being adjusted as shown, in which case the large pouch will hang generally straight down as described above and shown in FIG. 17.

Once at the destination, the buckle arrangements and restraining straps S of the carrier 10 can be released, the walker legs 355 unfolded, and the patient's articles and personal belongings contained in the storage compartments of the small and large pouches are again readily accessible to the patient as described above. Thus FIG. 18 illustrates the unique configuration of the carrier 10 in the combined transport and holder modes (sixth mode) during which various articles and personal belongings of the patient can be securely contained in the storage compartments of the pouches during transport of the walker 350, making the articles and personal belongings available to the user when needed without the user having to carry them separately from the walker 350.

It will be appreciated from the foregoing description that the present invention provides a unique, highly versatile multipurpose carrier 10 that can be readily releasably mounted to a walker of the collapsible type for achieving a configuration in which the carrier 10 is used in the accessory mode as an accessory of the walker to hold items and articles when the walker is in use in the non-collapsed state, as shown in FIG. 17. It will also be appreciated that the unique structural configuration of the carrier 10 also facilitates converting the configuration shown in FIG. 17 to a configuration in which the carrier 10 is used in a transport mode for carrying the walker 350 in the collapsed state, as shown in FIG. 18. Another unique feature of the configurations shown in FIGS. 17 and 18 is that the carrier 10 is not required to be removed from the walker when converting from the configuration shown in FIG. 17 to the configuration shown in FIG. 18. Another unique feature is that the carrier 10 is configured to hold articles and personal items of the patient in both the non-collapsed (FIG. 17) and collapsed (FIG. 18) of the walker 350, that is, both when the walker is being used and when it is being transported by the carrier 10. The multipurpose carrier 10 of the present invention may be used with various types of walkers and walker supports having various shapes and designs, with the walker support 350 shown in FIGS. 17 and 18 being representative of such devices. Furthermore, the carrier 10 is also particularly adapted for use with durable medical devices other than walkers, such as wheelchairs and other types of medical related chairs.

As described above, FIG. 18 illustrates an embodiment of the transport mode of the multipurpose carrier 10 of the present invention in which the carrier 10 is configured to transport, but not store, a portable device of the collapsible type in the collapsed state of the device. While this embodiment of the transport mode has been exemplified with a particular application to a portable walker of the collapsible type, it is understood that this embodiment of the transport mode is also suitable for and can be readily achieved with portable devices of the collapsible type other than portable collapsible walkers, including the portable chairs of the collapsible type described above with reference to FIGS. 15 and 16.

FIGS. 19-22 illustrate the storage mode (third mode) and the combined storage and transport modes (fifth mode) of the multipurpose carrier 10 during which the carrier 10 is configured and adapted to only store and to store and transport, respectively, a portable device of the collapsible type, such as the portable chair of the collapsible type 250 described above with reference to FIG. 16. The chair 250 may be a sports chair, for example. FIGS. 19-22 is also representative of the combined holder, storage and transport modes (sixth mode) of the carrier 10 in which the pouches are further configured to securely hold various articles during storage and transportation of the portable device of the collapsible type.

FIG. 19 is a perspective view showing the combined storage and transport modes of the carrier 10 in which the collapsed chair 250 is being both stored and transported by the carrier 10. In this configuration, the chair 250 is transported by the carrier 10 placing the holder strap 44 over the user's shoulder, with clips 44*a*, 44*b* of the holder strap 44 attached to eyelets 30, 34, respectively, which are located at attachment regions A2, D2, respectively, as shown in FIG. 3. While the collapsed chair 250 is being stored and/or transported by the carrier 10, the small and/or large pouches may be further used to hold various articles, such as beach or sports gear. As such, the carrier 10 is also uniquely configured and adapted for use in the combined holder, storage and transport modes (sixth mode) as described above.

Referring back to FIG. 11, in one particular example the dimension/denoting the distance between the connection region A2 and the longitudinal end 15 and the dimension a denoting the distance between the connection region D2 and the longitudinal end 17 are selected so that the clip 44*a* is attached at about 3 inches (i.e., dimension/is about 3 inches) from the longitudinal end 15 (i.e., the top of the main body 13) and the clip 44*b* is attached at about 5 inches (i.e., dimension a is about 5 inches) from the longitudinal end 17 (i.e., the bottom of the main body 13). As previously described, the carrying strap 44 is selected with dimensions sufficient so that the carrier 10 can be transported over the user's shoulder.

Figure 20:
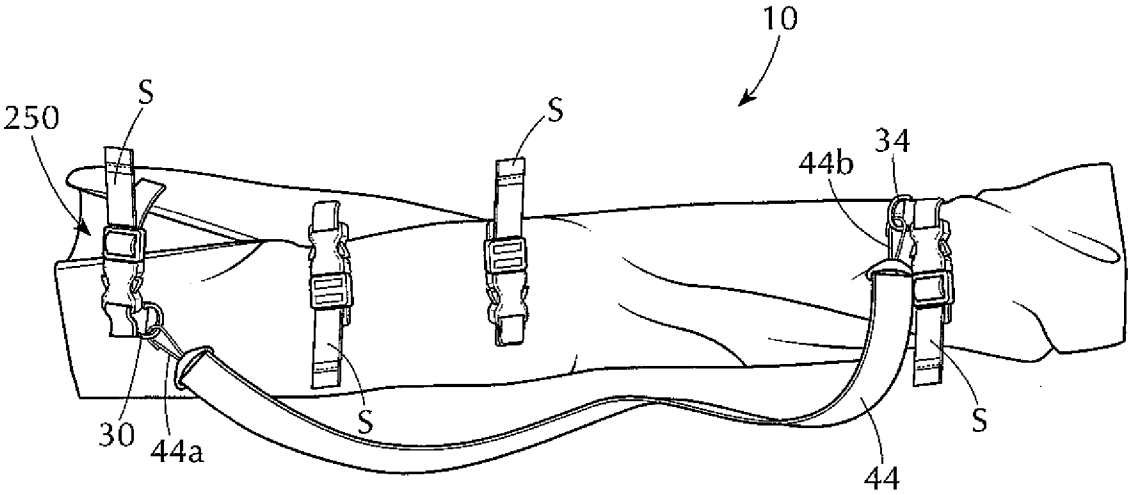
FIG. 20 is a side view in perspective of the multipurpose carrier in FIG. 19 showing a state in which the portable chair in the collapsed state is completely stored within the multipurpose carrier.

FIG. 20 is a side view illustrating the storage mode of the carrier 10 in which the collapsed chair 250 is only being stored (i.e., not transported) by the carrier 10. The collapsed chair 250 is placed into the compartment 56 of the large pouch which provides a cavity for receiving and housing the collapsed chair. To facilitate placement of the collapsed chair into the compartment 56, the closure panel or flap 18 is preferably previously inserted into the compartment 56. Although not shown in the drawings, portions of the two corners of the closure flap 18 defined by the sides 18*a*, 18*b* and 18*b*, 18*c* may be tapered inwardly (i.e., the width b of the closure flap 18 is reduced from each of the sides 18*a* and 18*c* toward the side 18*b*) in order to facilitate insertion of the closure flap 18 into the compartment 56. After placement of the collapsed chair 250 into the compartment 56 of the large pouch, the carrier 10 is closed by pulling the elongated edges (i.e., lateral side edges 19, 23) of the main body 13 toward each other and securing the resulting configuration using the connecting elements described above with reference to FIG. 2, such as by buckling together the male/female ends of the buckle arrangements and tightening the corresponding straps S to achieve the configuration shown in FIG. 20.

Figure 21:
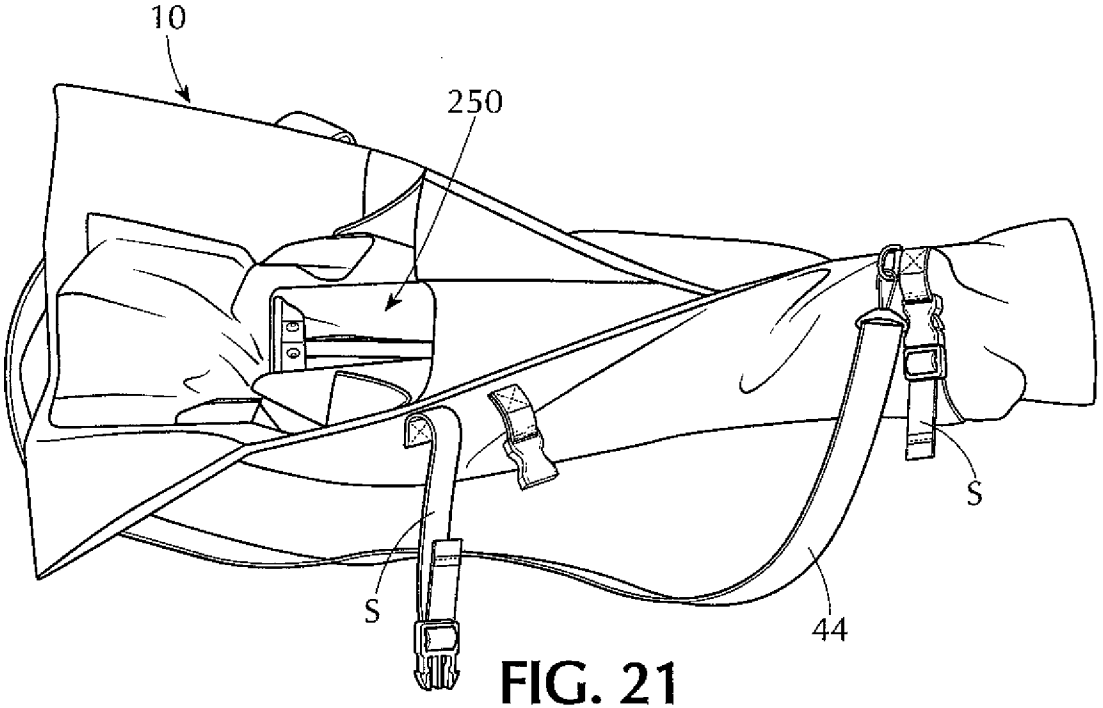
FIG. 21 is a side view of the multipurpose carrier in FIG. 20 showing certain connecting elements disconnected and the main body partially unfolded to partially expose the stored portable chair.

From the configuration of the carrier 10 shown in FIG. 20, the collapsed chair 250 can be removed from the carrier 10 by unbuckling the male/female ends of the buckle arrangements and releasing the corresponding straps S so that the collapsed chair 250 is revealed, as shown for example in FIG. 21. The carrier 10 is then unfolded by pulling the elongated edges of the main body 13 away from each other to place the carrier in the state shown in FIG. 22, for example, so that the collapsed chair 250 can be easily removed from the compartment 56 of the large pouch. At this point, the chair 250 can then be reassembled to the non-collapsed state for use in the accessory mode as described above for the configuration 200 shown in FIG. 16.

It will be appreciated from the exemplary embodiment shown in FIGS. 19-22 that the present invention provides a highly versatile multipurpose carrier 10 which can be selectively used in various modes, including the storage mode only, the combined storage and transport modes, and the combined holder, storage and transport modes, and which can be readily adapted from any of these various modes for use in the accessory mode for holding various articles within the storage compartments of the small and large pouches.

Although in the exemplary embodiment shown in FIGS. 19-22 the carrier 10 is described for storing and carrying only one portable device of the collapsible type, such as a portable collapsible chair, it will be appreciated that in the various modes described above with reference to FIGS. 19-22 the multipurpose carrier 10 can be configured for storing and carrying more than one portable device of the collapsible type depending on the particular dimensions of the carrier 10 and the portable device in the collapsed state. It will also be appreciated that even though the carrier 10 is described herein as being configured and used to store and/or transport one or more portable devices of the collapsible type, the carrier 10 may also be configured and used to store and/or transport non-collapsible type items and devices having dimensions which may be adapted to fit within the overall dimensions of the carrier 10, including the dimensions of the large pouch. For example, the carrier 10 of the present invention is also adapted for use to store and/or transport various types of camping, hunting and sports equipment, whether they are of the collapsible or non-collapsible type.

It will be appreciated from the exemplary embodiments described above with reference to FIGS. 1-22 that the multipurpose carrier 10 according to the present invention is configurable to a plurality of modes, each mode being adapted to a desired function or functions. It will be appreciated, however, that the multipurpose carrier of the present invention is not limited to the specific modes and corresponding functions described herein, and that other modes and corresponding functions are also contemplated within the spirit and scope of the present invention.

For example, the first mode of the multipurpose carrier 10 described above is defined as a holder mode during which the multipurpose carrier 10 is configured and adapted for use independently as a bag or tote for holding a variety of articles in the storage compartments of the pouches. In an alternative mode, the multipurpose carrier 10 according to the present invention is configurable for use in the first mode as a backpack as described below.

Referring again to FIG. 3, the clips 44*a*, 44*b* of the holder strap 44 are attached to eyelets 30, 34, respectively, so that the holder strap 44 extends substantially along the lateral side edge 23 of the main body 13. In this configuration, the holder strap 44 provides one of two shoulder straps configured to be placed over the user's shoulders to mount the multipurpose carrier 10 over the user's back for use as a backpack.

The other shoulder strap for the backpack is assembled as follows so as to extend substantially along the lateral side edge 19 of the main body 13. The connecting element including male buckle end 22*a* and corresponding strap S is fixedly mounted to attachment region A1 provided on a bottom surface portion of the base panel 16 corresponding to the second section of the main body 13. The connecting element including female buckle end 28*b* and corresponding strap S is fixedly mounted to attachment region D1 provided on a bottom surface portion of the base panel 16 corresponding to the first section of the main body 13. The length of the strap S mounted to attachment region A1 is suitably adjusted and the male buckle end 22*a* is securely connected to the female buckle end 28*b* to form the other shoulder strap so as to extend substantially along the lateral side edge 19 of the main body 13 with suitable slack as illustrated by the holder strap 44. In this state, the two shoulder straps are configured to be placed over the user's shoulders to mount the multipurpose carrier 10 over the user's back (e.g., the rear surface of the main body 13 is mounted directly on the user's back) for use as a backpack with the small and large pouches being readily accessible to facilitate the insertion and removal of various articles into and from the storage compartments.

In another alternative mode (not shown), the carrier 10 according to the present invention is configurable and adapted as a cushion device which may be laid flat so that it can be used for sitting or laying down. For example, the carrier 10 may be configured into a cushion device by inserting one or more cushion elements (e.g., one or more sections or pieces of a foam material) into one or both of the storage compartments in the pouches of the carrier 10 and sealing the pouch openings to securely retain the cushion elements within the compartments.

In another alternative mode also corresponding to another aspect of the present invention, the multipurpose carrier of the present invention forms part of an assembly that includes at least one portable device of the collapsible or the non-collapsible type.

Figure 22:
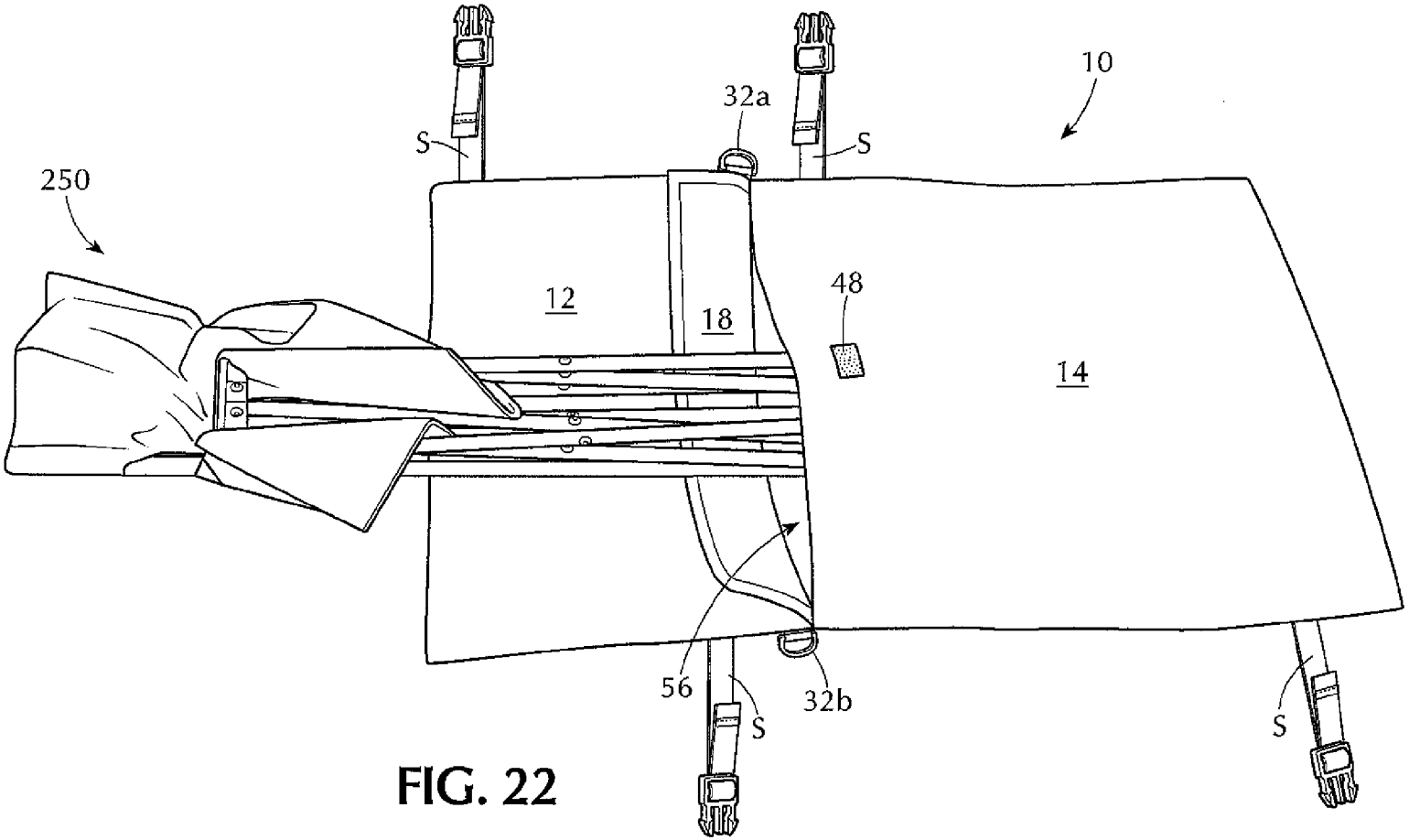
FIG. 22 is a perspective view of the multipurpose carrier in FIG. 21 showing the main body completely unfolded and the closure panel opened to allow the portable chair in the collapsed state to be inserted into and removed from the first pouch.

Referring again to FIGS. 16 and 19-22, in one exemplary embodiment the assembly includes the portable chair 250 of the collapsible type configured to be transitioned between a collapsed state (FIG. 22) and a non-collapsed state (FIG. 16), and the multipurpose carrier 10 is configurable in a plurality of modes, including a holder mode, a storage mode and a transport mode, as described above for the exemplary embodiments. As shown in FIG. 16, in the holder mode the multipurpose carrier of the assembly is configured to be securely mounted to the chair 250 in the non-collapsed state for use as a holder of various articles that can be inserted into and removed from the storage compartments of the small and large pouches as previously described above. As shown in FIGS. 20-22, in the storage mode the multipurpose carrier 10 of the assembly is configured to securely store the chair 250 in the collapsed state as previously described above. As shown in FIG. 19, in the transport mode the multipurpose carrier 10 of the assembly is configured to transport the chair 250 that is stored in the multipurpose carrier 10 as shown in FIG. 20, as previously described above. FIG. 19 is also representative of an assembly including the multipurpose carrier 10 configurable into the combined holder, storage and transport modes, as described above for the foregoing exemplary embodiments.

It will be appreciated that the assembly of the present invention is not limited to a portable chair of the collapsible type, but may include instead other types of portable devices of the collapsible type, such as various portable tools and portable sports and camping equipment of the collapsible type. Additionally, a portable device of the non-collapsible type may be used in the assembly instead of the portable device of the collapsible type, provided that the multipurpose carrier 10 is suitably configured and dimensioned for storing and carrying such portable device of the non-collapsible type. Furthermore, the assembly is not limited to one portable device of the collapsible or non-collapsible type, and may include instead more than one portable device of the collapsible or non-collapsible type or a combination of such collapsible and non-collapsible devices.

The assembly according to the present invention is also suitable for use as an advertising device or a promotional item as described above for the forgoing exemplary embodiments. This and other features and advantages of the assembly resulting from the multipurpose carrier according to the present invention are as described above with reference to the foregoing exemplary embodiments.

It will be appreciated from the foregoing description of the various exemplary embodiments that the present invention provides a highly versatile multipurpose carrier provided with storage compartments and configurable to a plurality of modes, each mode being adapted to a desired function or functions. The present invention further provides an advertising device utilizing the multipurpose carrier, as well as an assembly including the multipurpose carrier.

In the plurality of modes, the multipurpose carrier of the present invention provides convenient access to the storage compartments for inserting into the storage compartments and removing therefrom a variety of articles. The multipurpose carrier is also easy to use and comfortable for a user to carry for short or long distances. The multipurpose carrier of the present invention is also light weight and rugged in construction and relatively inexpensive to manufacture.

The foregoing description of preferred embodiments and best mode of the invention known to the applicant at the time of filing the application has been presented and is intended for the purposes of illustration and description. It is not intended to be exhaustive or limit the invention to the precise form disclosed and many modifications and variations are possible in the light of the above teachings. The embodiments were chosen and described in order to best explain the principles of the invention and its practical application and to enable others skilled in the art to best utilize the invention in various embodiments and with various modifications as are suited to the particular use contemplated. Therefore, it is intended that the invention not be limited to the particular embodiments disclosed for carrying out this invention, but that the invention will include all embodiments falling within the scope of the appended claims.

What is claimed is:

1. A multipurpose carrier configurable in a plurality of modes, comprising: a main body having front and rear sides and first and second pouches each provided with a storage compartment for removably storing various articles in the plurality of modes of the multipurpose carrier and provided with an opening accessible from the front side of the main body for permitting the articles to be inserted into and removed from the storage compartment, the main body including a folding zone that separates the main body into a first section containing the first pouch and a second section containing the second pouch and about which the first and second sections are configured to be folded relative to one another to position the second pouch into substantial overlying relation relative to a surface portion of the rear side of the main body; wherein the main body comprises a base panel and two top panels fixedly attached to a first surface of the base panel, one of the top panels and a portion of the first surface of the base panel forming the first pouch, and the other of the top panels and another portion of the first surface of the base panel forming the second pouch; wherein the base panel has a second surface forming the rear side of the main body; and wherein surfaces of the top panels form the front surface of the main body.

2. A multipurpose carrier according to claim 1; further comprising a connection assembly securely mounted on the main body for securing and/or configuring the multipurpose carrier in the plurality of modes; wherein the front and rear sides of the main body are bounded by opposite longitudinal ends and opposite lateral side edges of the main body; and wherein the connection assembly comprises a plurality of connecting elements fixedly attached to attachment regions provided at preselected portions of the rear side of the main body corresponding to the first and section sections, a first pair of ring-shaped members mounted to a respective first pair of the attachment regions each provided at the preselected portion of the rear side of the main body corresponding to one of the first and second sections, and a second pair of ring-shaped members mounted to the lateral sides of the main body at at respective ends of the folding zone.

3. An advertising device comprising:

a multipurpose carrier according to claim 1; and advertising indicia provided on at least one surface of at least one of the rear side the first pouch, and the second pouch of the main body.

4. A multipurpose carrier according to claim 1; further comprising a connection assembly securely mounted on the main body for securing and/or configuring the multipurpose carrier in the plurality of modes; wherein the connection assembly comprises a plurality of connecting elements fixedly attached to respective attachment regions provided at preselected portions of the rear side of the main body corresponding to the first and second sections.

5. A multipurpose carrier according to claim 4; wherein the front and rear sides of the main body are bounded by opposite longitudinal ends and opposite lateral side edges of the main body; and wherein the attachment regions comprise one pair of attachment regions provided on the second section at a first distance from one of the longitudinal ends, and another pair of attachment regions provided on the first section at a second distance from the other of the longitudinal ends.

6. A multipurpose carrier according to claim 5; wherein the first distance is less than the second distance.

7. A multipurpose carrier according to claim 4; wherein the attachment regions comprise one pair of attachment regions provided on the second section at a first distance from a centerline of the folding zone, and another pair of attachment regions provided on the first section at a second distance from the centerline of the folding zone.

8. A multipurpose carrier according to claim 6; wherein the first distance is equal to the second distance.

9. A multipurpose carrier according to claim 4; wherein the front and rear sides of the main body are bounded by opposite longitudinal ends and opposite lateral side edges of the main body; and wherein the attachment regions comprise a plurality of first attachment regions disposed on one side of a centerline of the main body extending between the lateral side edges, and a plurality of second attachment regions disposed on another side of the main body centerline, each of the plurality of first and second attachment regions being disposed at an equal distance from the main body centerline.

10. A multipurpose carrier configurable in a plurality of modes, comprising: a main body having front and rear sides and first and second pouches each provided with a storage compartment for removably storing various articles in the plurality of modes of the multipurpose carrier and provided with an opening accessible from the front side of the main body for permitting the articles to be inserted into and removed from the storage compartment, the main body including a folding zone that separates the main body into a first section containing the first pouch and a second section containing the second pouch and about which the first and second sections are configured to be folded relative to one another to position the second pouch into substantial overlying relation relative to a surface portion of the rear side of the main body; wherein the storage compartment of the first pouch has a capacity greater than that of the storage compartment of the second pouch; wherein the front and rear sides of the main body are bounded by opposite longitudinal ends and opposite lateral side edges of the main body, the opposite longitudinal ends defining respective bottom portions of the storage compartments of the first and second pouches; and wherein the folding zone extends from one lateral side edge to the other lateral side edge of the main body with one end of the folding zone terminating at one of the lateral side edges and the other end of the folding zone terminating at the other of the lateral side edges, the entire folding zone being disposed closer to the longitudinal end of the main body defining the bottom portion of the storage compartment of the second pouch than to the longitudinal end of the main body defining the bottom portion of the storage compartment of the first pouch.

11. A multipurpose carrier configurable in a plurality of modes, comprising: a main body having front and rear sides and first and second pouches each provided with a storage compartment for removably storing various articles in the plurality of modes of the multipurpose carrier and provided with an opening accessible from the front side of the main body for permitting the articles to be inserted into and removed from the storage compartment, the main body including a folding zone that separates the main body into a first section containing the first pouch and a second section containing the second pouch and about which the first and second sections are configured to be folded relative to one another to position the second pouch into substantial overlying relation relative to a surface portion of the rear side of the main body; wherein the multipurpose carrier further comprises a closure panel fixedly attached to the first surface of the base panel for selectively opening and closing the opening of the first pouch, and a closure device for selectively opening and closing the opening of the second pouch; wherein the front and rear sides of the main body are bounded by opposite longitudinal ends and opposite lateral side edges; wherein the folding zone is formed by a pair of spaced-apart stitch lines extending along the opposite longitudinal ends and between the opposite lateral side edges; and wherein the closure panel is attached to the first surface of the base panel by the pair of spaced-apart stitch lines forming the folding zone.

12. A multipurpose carrier configurable in a plurality of modes, comprising: a main body having front and rear sides and first and second pouches each provided with a storage compartment for removably storing various articles in the plurality of modes of the multipurpose carrier and provided with an opening accessible from the front side of the main body for permitting the articles to be inserted into and removed from the storage compartment, the main body including a folding zone that separates the main body into a first section containing the first pouch and a second section containing the second pouch and about which the first and second sections are configured to be folded relative to one another to position the second pouch into substantial overlying relation relative to a surface portion of the rear side of the main body; wherein the front and rear sides of the main body are bounded by opposite longitudinal ends and opposite lateral side edges of the main body; wherein the folding zone extends from one lateral side edge to the other lateral side edge of the main body with opposite ends of the folding zone terminating at the respective lateral side edges; and further comprising a connection assembly securely mounted on the main body for securing and/or configuring the multipurpose carrier in the plurality of modes; wherein the connection assembly comprises a plurality of connecting elements fixedly attached to respective attachment regions provided at preselected portions of the rear side of the main body corresponding to the first and second sections, a first pair of ring-shaped members mounted to respective attachment regions corresponding to the first and second sections, and a second pair of ring-shaped members mounted to and extending from the respective opposite ends of the folding zone.

13. A multipurpose carrier according to claim 12; wherein the plurality of connecting elements comprise a plurality of pairs of mating male and female connectors each fixedly attached by a strap to one of the attachment regions.

14. A multipurpose carrier according to claim 12; wherein the opposite longitudinal ends of the main body define respective bottom portions of the storage compartments of the first and second pouches; and further comprising a third pair of ring-shaped members mounted to and extending from the longitudinal end of the main body corresponding to the bottom portion of the storage compartment of the first pouch.

15. A multipurpose carrier according to claim 14; further comprising a pair of fasteners secured to the front side of the main body proximate the opening of the first pouch for releasable engagement with the third pair of ring-shaped members to adjust the size of the first pouch.

16. A multipurpose carrier configurable in a plurality of modes, comprising: a main body having front and rear sides and first and second pouches each provided with a storage compartment for removably storing various articles in the plurality of modes of the multipurpose carrier and provided with an opening accessible from the front side of the main body for permitting the articles to be inserted into and removed from the storage compartment, the main body including a folding zone that separates the main body into a first section containing the first pouch and a second section containing the second pouch and about which the first and second sections are configured to be folded relative to one another to position the second pouch into substantial overlying relation relative to a surface portion of the rear side of the main body; wherein the front and rear sides of the main body are bounded by opposite longitudinal ends and opposite lateral side edges of the main body; wherein the main body is formed of a plurality of panels of a flexible material stitched together along marginal edges thereof to provide the first and second pouches, the longitudinal ends and the lateral side edges of the main body corresponding to marginal edges of the panels; and wherein the folding zone is formed by a pair of spaced-apart stitch lines extending along the opposite longitudinal ends and between the opposite lateral side edges of the main body; and wherein the main body comprises a base panel, two top panels fixedly attached to a first surface of the base panel, and a closure panel by which the opening of the first pouch is opened and closed; wherein one of the top panels and a portion of the first surface of the base panel form the first pouch, and the other of the top panels and another portion of the first surface of the base panel form the second pouch; and wherein the closure panel is connected to the base panel by the pair of spaced-apart stitch lines forming the folding zone.

17. An assembly comprising:

at least one portable device of the collapsible type configured to be transitioned between a collapsed state and a non-collapsed state; and a multipurpose carrier having at least one storage compartment and being configurable in a plurality of modes, including a holder mode during which the multipurpose carrier is removably secured to the portable device in the non-collapsed state for holding a variety of articles in the storage compartment, and a transport mode during which the multipurpose carrier stores and transports the portable device in the collapsed state;

wherein in the transport mode the portable device is disposed at least partially inside the at least one storage compartment.

18. An assembly according to claim 17; wherein the at least one portable device of the collapsible type comprises a portable chair of the collapsible type, the portable chair having a back rest provided with a top rail; wherein the multipurpose carrier has a main body including a folding zone separating the main body into a first section containing the storage compartment and a second section containing another storage compartment and about which the first and second sections are configured to be folded relative to one another; and wherein in the holder mode in which the portable chair is in the non-collapsed state, the first and second sections of the main body of the multipurpose carrier are folded relative to one another so that the first and second sections are disposed on opposite sides of the back rest of the portable chair with the folding zone substantially overlying the top rail.

19. An advertising device comprising:

an assembly according to claim 17; and advertising indicia provided on at least one outer surface of the storage compartment in the multipurpose carrier of the assembly.

20. An assembly according to claim 18; wherein the at least one storage compartment comprises two storage compartments; and wherein the multipurpose carrier comprises a main body having front and rear sides and first and second pouches each provided with one of the two storage compartments for removably storing various articles in the holder mode and provided with an opening accessible from the front side of the main body for permitting the articles to be inserted into and removed from the storage compartment, the main body including a folding zone that separates the main body into a first section containing the first pouch and a second section containing the second pouch and about which the first and second sections are folded relative to one another in the holder mode.

21. An assembly according to claim 20; wherein the at least one portable device of the collapsible type comprises a portable chair of the collapsible type, the portable chair having a back rest provided with a top rail; and wherein in the holder mode the first and second sections of the main body of the multipurpose carrier are folded relative to one another with the first and second sections disposed on opposite sides of the back rest of the portable chair and the folding zone substantially overlying the top rail while providing access to the openings of the two compartments from the front side of the main body to permit articles to be inserted into and removed from the two storage compartments.

22. A method of using a carrier in combination with a portable device of the collapsible type configured to be transitioned between a collapsible state and a non-collapsible state, the method comprising:

providing a multipurpose carrier having at least one storage compartment and being configurable to a plurality of modes each adapted to a desired function or functions;

disposing the multipurpose carrier relative to the portable device while in the non-collapsed state to configure the multipurpose carrier to a holder mode during which one or more articles may be inserted into and removed from the storage compartment of the multipurpose carrier; and removably securing the multipurpose carrier relative to the portable device while in the collapsed state to configure the multipurpose carrier to a combined storage and transport mode during which the multipurpose carrier is configured for both storing and transporting the collapsed portable device while the collapsed portable device is disposed at least partially inside the at least one storage compartment.

23. A method according to claim 22; wherein the portable device of the collapsible type comprises a portable chair of the collapsible type, the portable chair having a back rest provided with a top rail; wherein the multipurpose carrier has a main body including a folding zone separating the main body into a first section containing the at least one storage compartment and a second section containing another storage compartment and about which the first and second sections are configured to be folded relative to one another; and wherein the multipurpose carrier is configured to the holder mode by folding the first and second sections of the main body relative to one another to dispose the first and second sections on opposite sides of the back rest of the portable chair with the folding zone substantially overlying the top rail.

24. A method according to claim 22; wherein the portable device of the collapsible type comprises a portable walker of the collapsible type, the portable walker having a plurality of support legs interconnected by a plurality of braces; wherein the multipurpose carrier has a main body including a folding zone separating the main body into a first section containing the at least one storage compartment and a second section containing another storage compartment and about which the first and second sections are configured to be folded relative to one another; and wherein the multipurpose carrier is configured to the holder mode by folding the first and second sections of the main body relative to one another to dispose the first and second sections on opposite sides of one of the braces with the folding zone substantially overlying the one brace.

25. A multipurpose carrier configurable in a plurality of modes, comprising: a main body having front and rear sides and first and second pouches each provided with a storage compartment for removably storing various articles in the plurality of modes of the multipurpose carrier and provided with an opening accessible from the front side of the main body for permitting the articles to be inserted into and removed from the storage compartment, the main body including a folding zone that separates the main body into a first section containing the first pouch and a second section containing the second pouch and about which the first and second sections are configured to be folded relative to one another to position the second pouch into substantial overlying relation relative to a surface portion of the rear side of the main body; wherein the front and rear sides of the main body are bounded by opposite longitudinal ends and opposite lateral side edges of the main body, the opposite longitudinal ends defining respective bottom portions of the storage compartments of the first and second pouches; wherein the folding zone is disposed between the opposite longitudinal ends and extends from one lateral side edge to the other lateral side edge of the main body with opposite ends of the folding zone terminating at the respective lateral side edges; and further comprising a connection assembly mounted on the main body for securing and/or configuring the multipurpose carrier in the plurality of modes, the connection assembly comprising first-fourth pairs of opposed connecting elements fixedly attached to respective first-fourth pairs of opposed attachment regions provided on the rear side of the main body, the first pair of attachment regions being disposed closer to the bottom portion of the storage compartment of the second pouch than to the folding zone, the second pair of attachment regions being disposed closer to the folding zone than to the bottom portion of the storage compartment of the second pouch, the third pair of attachment regions being disposed closer to the folding zone than to the bottom portion of the storage compartment of the first pouch, and the fourth pair of attachment regions being disposed closer to the bottom portion of the storage compartment of the first pouch than to the folding zone.

26. A multipurpose carrier according to claim 25; further comprising a first pair of ring-shaped members for releasable connection thereto of a carrying strap for carrying the multipurpose carrier in at least one of the plurality of modes, one of the first pair of ring-shaped members being connected to and extending from one of the attachment regions of the first pair of attachment regions and the other of the first pair of ring-shaped members being connected to and extending from one of the attachment regions of the fourth pair of attachment regions.

27. A multipurpose carrier according to claim 26; further comprising a second pair of ring-shaped members for releasable connection thereto of the carrying strap for carrying the multipurpose carrier in another of the plurality of modes different from the at least one of the plurality of modes, the first pair of ring-shaped members being connected to and extending from respective opposite ends of the folding zone.

28. A multipurpose carrier according to claim 27; further comprising a third pair of ring-shaped members connected to and extending from the bottom portion of the storage compartment of the first pouch; and further comprising a pair of fasteners secured to the front side of the main body proximate the opening of the first pouch for releasable engagement with the third pair of ring-shaped members to fold portions of the first section relative one another for adjusting the size of the first pouch.

29. A multipurpose carrier according to claim 25; further comprising a pair of ring-shaped members for releasable connection thereto of a carrying strap for carrying the multipurpose carrier in at least one of the plurality of modes, the first pair of ring-shaped members being connected to and extending from respective opposite ends of the folding zone.

30. A multipurpose carrier configurable in a plurality of modes, comprising: a main body having front and rear sides and first and second pouches each provided with a storage compartment for removably storing various articles in the plurality of modes of the multipurpose carrier and provided with an opening accessible from the front side of the main body for permitting the articles to be inserted into and removed from the storage compartment, the main body including a folding zone that separates the main body into a first section containing the first pouch and a second section containing the second pouch and about which the first and second sections are configured to be folded relative to one another to position the second pouch into substantial overlying relation relative to a surface portion of the rear side of the main body; wherein the front and rear sides of the main body are bounded by opposite longitudinal ends and opposite lateral side edges of the main body with the opposite longitudinal ends defining respective bottom portions of the storage compartments; and further comprising a pair of ring-shaped members mounted to and extending from the longitudinal end of the main body corresponding to the bottom portion of the storage compartment in the first section, and a pair of fasteners secured to the front side, the multipurpose carrier being configurable into a bag for removably storing various articles in the storage compartments of the first and second pouches by folding the first section from the bottom portion of the storage compartment thereof towards the second section and bringing the pair of ring-shaped members into releasable engagement with the pair of fasteners.

31. In combination with a device of the collapsible or non-collapsible type having a support portion, a multipurpose carrier configurable in a plurality of modes, comprising: a main body having front and rear sides and first and second pouches each provided with a storage compartment for removably storing various articles in the plurality of modes and provided with an opening accessible from the front side of the main body for permitting the articles to be inserted into and removed from the storage compartment, the main body including a folding zone that separates the main body into a first section containing the first pouch and a second section containing the second pouch and about which the first and second sections are configured to be folded relative to one another to position the second pouch into substantial overlying relation relative to a surface portion of the rear side of the main body to thereby position the first and second sections on opposite sides of the support portion of the device; wherein the main body comprises a base panel and two top panels fixedly attached to a first surface of the base panel, one of the top panels and a portion of the first surface of the base panel forming the first pouch, and the other of the top panels and another portion of the first surface of the base panel forming the second pouch; wherein the base panel has a second surface forming the rear side of the main body; and wherein surfaces of the top panels form the front surface of the main body.

32. A combination according to claim 31; wherein the device comprises a chair having a back rest provided with a top rail defining the support portion, the first and second sections of the multipurpose carrier being disposed on opposite sides of the back rest while the folding zone substantially rests on the top rail.

33. A combination according to claim 31; wherein the device comprises a walker having support legs interconnected by braces with at least one of the braces defining the support portion, the first and second sections of the multipurpose carrier being disposed on opposite sides of the at least one brace while the folding zone substantially rests on the at least one brace.

34. A combination according to claim 31; further comprising advertising indicia provided on an outer surface of at least one of the first and second sections of the main body.

35. A combination according to claim 31; further comprising a connection assembly securely mounted on the main body for securing the multipurpose carrier to the device; wherein the connection assembly comprises a plurality of connecting elements fixedly attached to respective attachment regions provided at preselected portions of the rear side of the main body corresponding to the first and second sections.

36. A combination according to claim 35; wherein the front and rear sides of the main body are bounded by opposite longitudinal ends and opposite lateral side edges of the main body; and wherein the attachment regions comprise one pair of attachment regions provided on the second section at a first distance from one of the longitudinal ends, and another pair of attachment regions provided on the first section at a second distance from the other of the longitudinal ends.

37. A combination according to claim 36; wherein the first distance is less than the second distance.

38. A combination according to claim 35; wherein the attachment regions comprise one pair of attachment regions provided on the second section at a first distance from a centerline of the folding zone, and another pair of attachment regions provided on the first section at a second distance from the centerline of the folding zone.

39. A combination according to claim 38; wherein the first distance is equal to the second distance.

40. A combination according to claim 35; wherein the front and rear sides of the main body are bounded by opposite longitudinal ends and opposite lateral side edges of the main body; and wherein the attachment regions comprise a plurality of first attachment regions disposed on one side of a centerline of the main body extending between the lateral side edges, and a plurality of second attachment regions disposed on another side of the main body centerline, each of the plurality of first and second attachment regions being disposed at an equal distance from the main body centerline.

41. In combination:

a portable walker of the collapsible type configured to be transitioned between a collapsed state and a non-collapsed state, the portable walker having a plurality of support legs interconnected by a plurality of braces; and a multipurpose carrier having storage compartments and being configurable in a plurality of modes, including a holder mode during which the multipurpose carrier is removably attached to the portable walker in the non-collapsed state for holding a variety of articles in the storage compartments, and a transport mode during which the multipurpose carrier transports the portable walker in the collapsed state;

wherein the multipurpose carrier comprises a main body having front and rear sides and first and second pouches provided with the respective storage compartments for removably storing the articles in the plurality of modes of the multipurpose carrier and each provided with an opening accessible from the front side of the main body for permitting the articles to be inserted into and removed from the storage compartment;

wherein the main body includes a folding zone that separates the main body into a first section containing the first pouch and a second section containing the second pouch and about which the first and second sections are configured to be folded relative to one another to position the second pouch into substantial overlying relation relative to a surface portion of the rear side of the main body; and wherein the main body comprises a base panel and two top panels fixedly attached to a first surface of the base panel, one of the top panels and a portion of the first surface of the base panel forming the first pouch, and the other of the top panels and another portion of the first surface of the base panel forming the second pouch; wherein the base panel has a second surface forming the rear side of the main body; and wherein surfaces of the top panels form the front surface of the main body.

42. A combination according to claim 41; wherein the multipurpose carrier comprises a plurality of connecting elements fixedly attached to a respective plurality of attachment regions provided on the second section at the rear side of the main body for removably securing the multipurpose carrier to the portable walker in the holder mode and in the transport mode; wherein the plurality of attachment regions comprise first and second pairs of attachment regions disposed on opposite sides of the folding zone at positions closer to the folding zone than to the closed end of the second storage compartment, and a third pair of attachment regions disposed closer to the closed end of the second storage compartment than to the folding zone.

43. A combination according to claim 42; wherein in the holder mode of the multipurpose carrier, the first and second sections of the main body are folded relative to one another about the folding zone so that the first and second sections are disposed on opposite sides of one of the braces of the portable walker with the folding zone substantially overlying the one brace, and the connecting elements attached to the first, second and third pairs of attachment regions are correspondingly connected together and secured to two of the support legs of the portable walker interconnected by the one brace; and wherein in the transport mode of the multipurpose carrier, the connecting elements attached to the first and second pair of attachment regions remain secured to the two support legs of the portable walker while in the collapsed state, and the connecting elements attached to the third pair of attachment regions are connected together and wrap around the plurality of support legs of the portable walker while in the collapsed state, thereby allowing the portable walker in the collapsed state to be transported by the multipurpose carrier.

44. A combination according to claim 41; wherein the multipurpose carrier is configurable from the holder mode to the transport mode without the multipurpose carrier being completely detached from the portable walker.

45. A combination according to claim 41; further comprising a connection assembly for removably mounting the multipurpose carrier to the portable walker in the holder mode and the transport mode, the connection assembly including a plurality of connecting elements fixedly attached to respective attachment regions provided at preselected portions of the rear side of the main body corresponding to the first and second sections.

46. A combination according to claim 45; wherein the attachment regions comprise a pair of attachment regions provided on the first section and two pairs of attachment regions provided on the second section; wherein in the holder mode and in the transport mode, the connecting elements attached to the pair of attachment regions on the first section being removably connected to the connecting elements attached to one of the two pairs of attachment regions on the second section; and further comprising a pair of connectors extending from opposite end portions of the folding zone of the main body of the multipurpose carrier, the pairs of connectors being configured for connection thereto of a carrying strap for carrying the portable walker in the transport mode.

47. A combination according to claim 46; wherein in the transport mode, the at least one storage compartment is accessible for holding a variety of articles while the portable walker is transported by the multipurpose carrier.

48. A combination according to claim 45; wherein the attachment regions comprise a first pair of attachment regions provided on the second section and a second pair of attachment regions provided on the first section, the first and second pairs of attachment regions being disposed on opposite sides of the folding zone at an equal distance from a centerline of the folding zone.

49. A combination according to claim 45; wherein the attachment regions comprise a plurality of attachment regions disposed on one side of a centerline of the main body crossing the longitudinal ends and extending between the lateral side edges, and plurality of attachment regions disposed on another side of the main body centerline, each of the plurality of attachment regions disposed on the one side and the another side of the main body centerline being disposed at an equal distance from the main body centerline.

50. In combination:

a portable walker of the collapsible type configured to be transitioned between a collapsed state and a non-collapsed state, the portable walker having a plurality of support legs interconnected by a plurality of braces; and a multipurpose carrier having at least one storage compartment and being configurable in a plurality of modes, including a holder mode during which the multipurpose carrier is removably attached to the portable walker in the non-collapsed state for holding a variety of articles in the at least one storage compartment, and a transport mode during which the multipurpose carrier transports the portable walker in the collapsed state;

wherein the multipurpose carrier comprises a plurality of connecting elements fixedly attached to a respective plurality of attachment regions provided on the first and second sections at the rear side of the main body for removably securing the multipurpose carrier to the portable walker in the holder mode and in the transport mode; wherein the plurality of attachment regions comprise first and second pairs of attachment regions disposed on opposite sides of the folding zone at positions closer to the folding zone than to the closed end of the second storage compartment, and a third pair of attachment regions disposed closer to the closed end of the second storage compartment than to the folding zone;

wherein in the holder mode of the multipurpose carrier, the first and second sections of the main body are folded relative to one another about the folding zone so that the first and second sections are disposed on opposite sides of one of the braces of the portable walker with the folding zone substantially overlying the one brace, and the connecting elements attached to the first, second and third pairs of attachment regions are correspondingly connected together and secured to two of the support legs of the portable walker interconnected by the one brace; and wherein in the transport mode of the multipurpose carrier, the connecting elements attached to the first and second pair of attachment regions remain secured to the two support legs of the portable walker while in the collapsed state, and the connecting elements attached to the third pair of attachment regions are connected together and wrap around the plurality of support legs of the portable walker while in the collapsed state, thereby allowing the portable walker in the collapsed state to be transported by the multipurpose carrier; and wherein the multipurpose carrier is configurable from the holder mode to the transport mode while the connecting elements attached to the first and second pair of attachment regions remain secured to the two support legs of the portable walker.

* * * * *